US006368454B1

(12) United States Patent
Dwiggins et al.

(10) Patent No.: US 6,368,454 B1
(45) Date of Patent: Apr. 9, 2002

(54) METHOD OF MAKING SOFT BULKY SINGLE PLY TISSUE

(75) Inventors: John H. Dwiggins, Neenah; T. Philips Oriaran, Appleton; Frank D. Harper, Neenah; Galyn A. Schulz, Greenville, all of WI (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/484,249

(22) Filed: Jan. 18, 2000

Related U.S. Application Data

(62) Division of application No. 09/049,071, filed on Mar. 27, 1998, now Pat. No. 6,033,523.
(60) Provisional application No. 60/042,903, filed on Mar. 31, 1997.

(51) Int. Cl.[7] ..... D21H 15/00; D21H 17/06; D21H 17/45; D21H 27/02

(52) U.S. Cl. ..... 162/117; 162/109; 162/158; 162/164.1; 162/164.3; 162/168.2; 162/179; 428/156

(58) Field of Search ..... 162/111–113, 109, 162/117, 125–127, 129, 131, 132, 133, 158, 164.1, 164.6, 179, 168.1–168.3; 428/172, 152–156

(56) References Cited

U.S. PATENT DOCUMENTS

| | | | | |
|---|---|---|---|---|
| 3,817,827 | A | | 6/1974 | Benz |
| 4,166,001 | A | | 8/1979 | Dunning et al. |
| D258,154 | S | | 2/1981 | Elchook, Jr. et al. |
| D260,193 | S | | 8/1981 | Elchook, Jr. et al. |
| 4,376,671 | A | | 3/1983 | Schulz |
| 4,447,294 | A | | 5/1984 | Osborn, III |
| 4,759,967 | A | | 7/1988 | Bauernfeind |
| D298,588 | S | | 11/1988 | Peddada |
| D300,693 | S | | 4/1989 | Grasso |
| 4,921,034 | A | | 5/1990 | Burgess et al. |
| D319,349 | S | | 8/1991 | Schultz et al. |
| 5,164,045 | A | | 11/1992 | Awofeso et al. |
| D332,876 | S | | 2/1993 | Shufelt et al. |
| 5,262,007 | A | | 11/1993 | Phan et al. |
| 5,300,347 | A | | 4/1994 | Underhill et al. |
| 5,328,565 | A | | 7/1994 | Rasch et al. |
| D361,895 | S | | 9/1995 | Arnone et al. |
| D362,121 | S | | 9/1995 | Nugent et al. |
| 5,562,805 | A | | 10/1996 | Kamps et al. |
| D375,633 | S | | 11/1996 | Spanagel et al. |
| 5,597,639 | A | | 1/1997 | Shulz |
| 5,609,725 | A | | 3/1997 | Van Phan |
| 5,695,607 | A | | 12/1997 | Oriaran et al. |
| 6,033,761 | A | * | 3/2000 | Dwiggins et al. ..... 428/172 |

* cited by examiner

*Primary Examiner*—Jose Fortuna
(74) *Attorney, Agent, or Firm*—Finnegan, Henderson, Farabow, Garrett & Dunner

(57) ABSTRACT

The present invention relates to a soft, thick, single-ply tissue and to a process for the manufacture of such tissue product having a basis weight of at least about 15 lbs./3,000 square foot ream and having low sidedness, said tissue exhibiting a specific total tensile strength of between 40 and 75 grams per 3 inches per pound per 3000 square feet ream, a cross direction specific wet tensile strength of between 2.75 and 7.5 grams per 3 inches per pound per 3000 square feet ream, the ratio of MD tensile to CD tensile of between 1.00 and 2.75, a specific geometric mean tensile stiffness of between 0.5 and 1.2 grams per inch per percent strain per pound per 3000 square feet ream, a ratio of product cross direction stretch to base sheet cross direction stretch of at least about 1.4, a friction deviation of less than 0.225, and a sidedness parameter of less than 0.275.

21 Claims, 12 Drawing Sheets

SCALE 10x

| DIM# | DESCRIPTION | DIM(mls) |
|---|---|---|
| 1 | LENGTH, TOP OF MALE ELEMENT | 2.3 |
| 2 | LENGTH, BOTTOM OF FEMALE ELEMENT | 2.3 |
| 3 | CD REPEAT OF MICRO | 92.6 |
| 4 | LENGTH, OPENING OF FEMALE ELEMENT | 35 |
| 5 | LENGTH, BASE OF MALE ELEMENT | 35 |
| 6 | WIDTH, TOP OF MALE ELEMENT | 23 |
| 7 | NO REPEAT OF MICRO | 92.5 |
| 8 | WIDTH, BASE OF FEMALE ELEMENT | 23 |
| 9 | WIDTH, OPENING OF FEMALE ELEMENT | 35 |
| 10 | WIDTH, BASE OF MALE ELEMENT | 35 |
| 11 | TOP OF MALE TO DEPTH OF FEMALE | 31 |
| 12 | TOP OF MALE TO MIDPLANE | 15.5 |
| 13 | MIDPLANE TO BOTTOM OF FEMALE | 15.5 |
| 14 | BOTTOM OF FEMALE DOME | 53 |

| DIM# | DESCRIPTION | DIM(mls) |
|---|---|---|
| 15 | OPENING FOR FEMALE DOME | 77 |
| 16 | BOTTOM OF FEMALE TULIP LINE | 20 |
| 17 | OPENING FOR FEMALE TULIP LINE | 44 |
| 18 | DEPTH OF FEMALE DOME | 31 |
| 19 | DEPTH OF FEMALE TULPLINE | 31 |

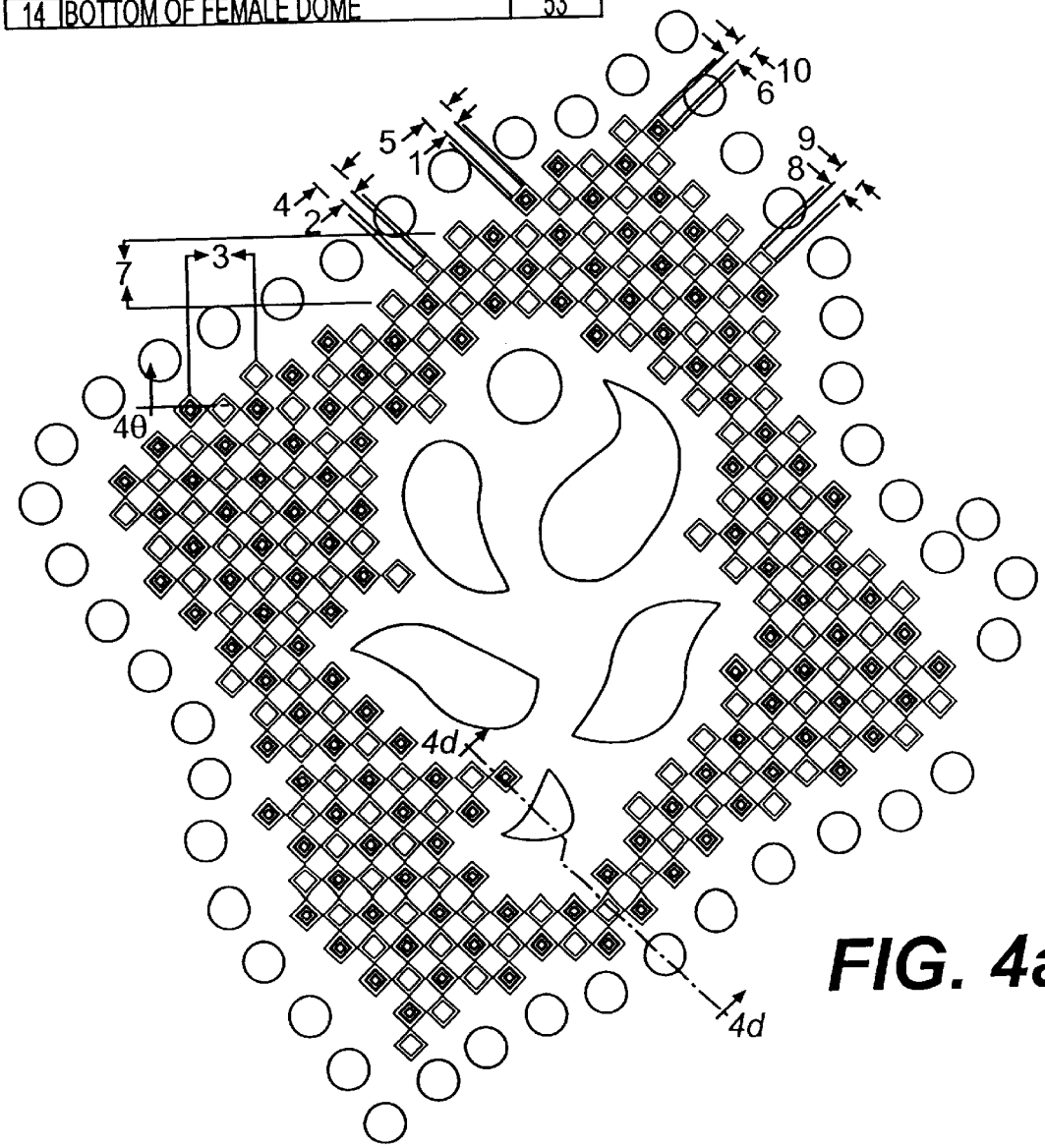

FIG. 4a

| DIM# | DESCRIPTION | DIM (mils) |
|---|---|---|
| 1 | LENGTH, TOP OF MALE ELEMENT | 23 |
| 2 | LENGTH, BOTTOM OF FEMALE ELEMENT | 23 |
| 3 | CD REPEAT | 92.5 |
| 4 | LENGTH, OPENING OF FEMALE ELEMENT | .15 |
| 5 | LENGTH, BASE OF MALE ELEMENT | .15 |
| 6 | WIDTH, TOP OF MALE ELEMENT | 23 |
| 7 | NO REPEAT | 92.5 |

| DIM# | DESCRIPTION | DIM (mils) |
|---|---|---|
| 8 | WIDTH, BASE OF FEMALE ELEMENT | 23 |
| 9 | WIDTH, OPENING OF FEMALE ELEMENT | .15 |
| 10 | WIDTH, BASE OF MALE ELEMENT | .15 |
| 11 | TOP OF MALE TO DEPTH OF FEMALE | 31 |
| 12 | TOP OF MALE TO MIDPLANE | 15.5 |
| 13 | MIDPLANE TO BOTTOM OF FEMALE | 15.5 |
| 14 | TOP O FMALE DOMES | 53 |
| 15 | BOTTOM OF MALE DOMES | 77 |
| 16 | TOP OF MALE TULIP LINE | 20 |
| 17 | BASE OF MALE TULIP LINE | 44 |
| 18 | HEIGHT OF DOMES | .31 |
| 19 | HEIGHT OF TULIP LINES | .31 |

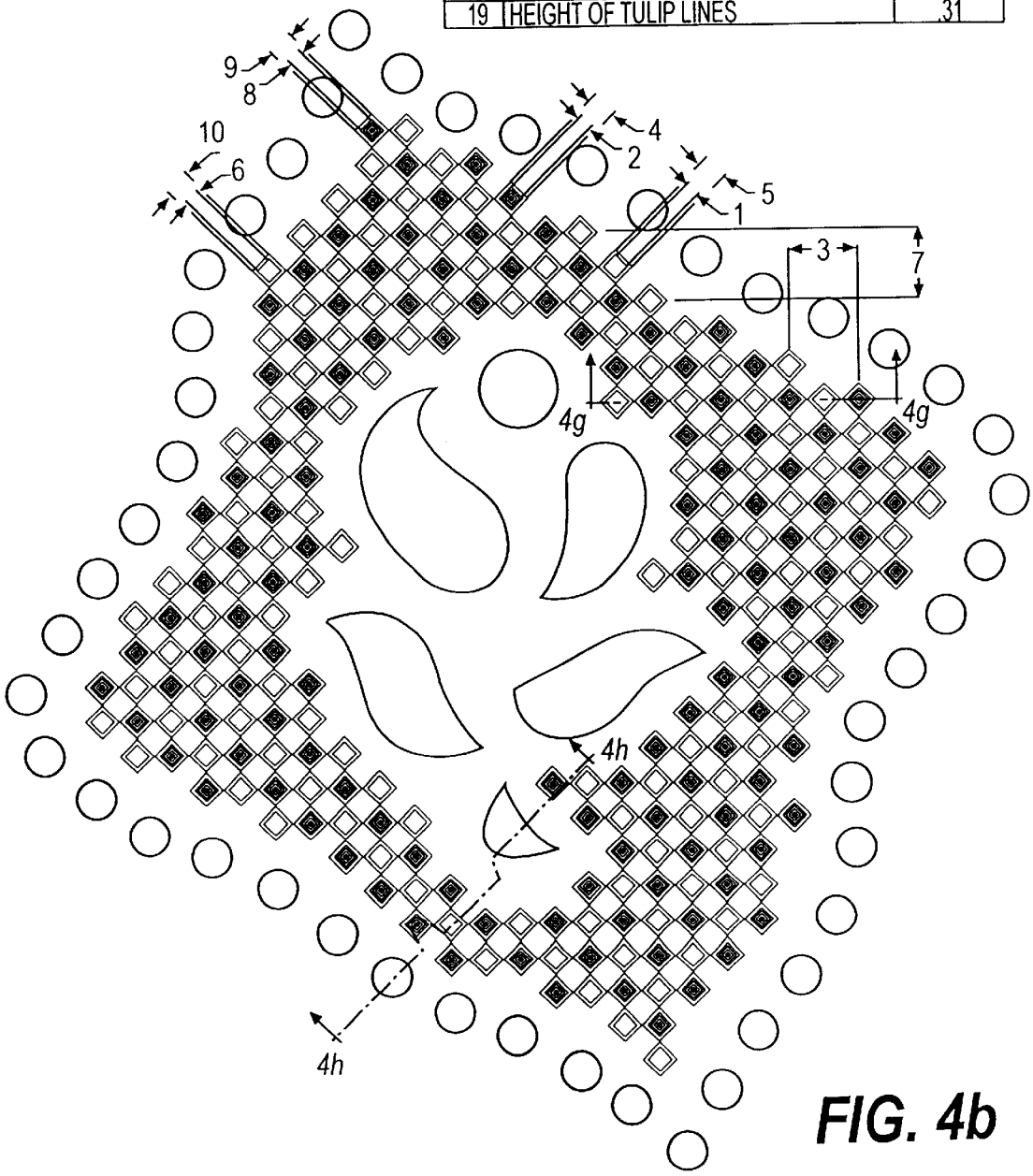

FIG. 4b

METHOD OF MAKING SOFT BULKY SINGLE PLY TISSUE

This is a division of application Ser. No. 09/049,071, filed Mar. 27, 1998, now U.S. Pat. No. 6,033,523 and claims the benefit of U.S. provisional application no. 60/042,903, filed Mar. 31, 1997, all of which are incorporated herein by reference.

FIELD OF THE INVENTION

The present invention is directed to a soft, strong in use, bulky single ply tissue paper having low sidedness and processes for the manufacture of such tissues.

BACKGROUND OF THE INVENTION

Through air drying has become the technology of preference for making tissue for many manufacturers who build new tissue machines as, on balance, through air drying ("TAD") offers many economic benefits as compared to the older techniques of conventional wet-pressing ("CWP"). With through air drying, it is possible to produce a single ply tissue with good initial softness and bulk as it leaves the tissue machine.

In the older wet pressing method, to produce a premium quality tissue, it has normally been preferred to combine two plies by embossing them together. In this way, the rougher air-side surfaces of each ply may be joined to each other and thereby concealed within the sheet. However, producing two-ply products, even on state of the art CWP machines, lowers paper machine productivity by about 20% as compared to a one-ply product. In addition, there may be a substantial cost penalty involved in the production of two-ply products because the parent rolls of each ply are not always of the same length, and a break in either of the single plies forces the operation to be shut down until it can be remedied. Also, it is not normally economic to convert older CWP tissue machines to TAD. But even though through air drying has often been preferred for new machines, conventional wet-pressing is not without its advantages as well. Water may normally be removed from a cellulosic web at lower energy cost by mechanical means such as by overall compaction than by drying using hot air.

What has been needed in the art is a method of making a premium quality single ply tissue using conventional wet pressing having a high bulk and excellent softness and absorbency attributes. In this way advantages can be taken of older CWP machines that can be used to produce high quality single ply tissue at a cost which is far lower than that associated with producing two-ply tissue.

Among the more significant barriers to production of a single ply CWP tissue have been the generally low softness and thickness and the extreme sidedness of single-ply webs. A tissue product's softness can be increased by lowering its strength, as it is known that softness and strength are inversely related. However, a product having very low strength will present difficulties in manufacturing and will be rejected by consumers as it will not hold up in use. Use of premium, low coarseness fibers, such as eucalyptus, and stratification of the furnish so that the premium softness fibers are on the outer layers of the tissue is another way of addressing the low softness of CWP products; however this solution is expensive to apply, both in terms of equipment and ongoing fiber costs. In any case, neither of these schemes addresses the problem of low thickness. TAD processes employing fiber stratification can produce a nice, soft, bulky sheet having adequate strength and good similarity of the surface texture on the front of the sheet as compared to the back. Having the same texture on front and back is considered to be quite desirable in these products or, more precisely, having differing texture is generally considered quite undesirable. Because of the deficiencies mentioned above, many single-ply CWP products currently found in the marketplace are typically low-end products. These products often are considered deficient in thickness, softness, and absorbency, and they exhibit excessive two sidedness. Accordingly, these products have had rather low consumer acceptance and are typically used in "away from home" applications in which the person buying the tissue is not the user.

We have found that we can produce soft, high basis weight, high strength CWP tissues with low sidedness by the judicious combination of several techniques as described herein. Basically, these techniques fall into four categories: (i) providing a web having a basis weight of at least 15 pounds for each 3,000 square foot ream; (ii) adding to the web a controlled amount of a temporary wet strength agent and softener/debonder; (iii) low angle, high percent crepe, high adhesion creping to give the product low stiffness and a high stretch; and (iv) embossing the tissue between malted emboss rolls, each of which has both male and female elements. By various combinations of these techniques as described, taught, and exemplified herein, it is possible to control the required degrees of softness, strength, absorbency and sidedness for the desired end use.

DESCRIPTION OF BACKGROUND ART

Paper is generally manufactured by suspending cellulosic fiber of appropriate geometric dimensions in an aqueous medium and then removing most of the liquid. The paper derives some if its structural integrity from the mechanical arrangement of the cellulosic fibers in the web, but most, by far, of the paper's strength is derived from hydrogen bonding which links the cellulosic fibers to one another. With paper intended for use as bathroom tissue, the degree of strength imparted by this inter-fiber bonding, while necessary to the utility of the product, can result in a lack of perceived softness that is inimical to consumer acceptance. One common method of increasing the perceived softness of bathroom tissue is to crepe the paper. Creping is generally effected by fixing the cellulosic web to Yankee drum thermal drying means with an adhesive/release agent combination and then scraping the web off the Yankee by means of a creping blade. Creping, by breaking a significant number of inter-fiber bonds increases the perceived softness of the resulting bathroom tissue product.

Another method of increasing a web's softness is through the addition of chemical softening and debonding agents. Compounds such as quaternary amines that function as debonding agents are often incorporated into the paper web. These A cationic quaternary amines can be added to the initial fibrous slurry from which the paper web is subsequently made. Alternatively, the chemical debonding agent may be sprayed onto the cellulosic web after it is formed but before it is dried.

As was mentioned above, one-ply bathroom tissue generally suffers from the problem of low thickness, lack of softness, and also "sidedness." Sidedness is introduced into the sheet during the manufacturing process. The side of the sheet that was adhered to the Yankee and creped off, i.e., the Yankee side, is generally softer than the "air" side of the sheet. This two-sidedness is seen both in sheets that have been pressed to remove water and in unpressed sheets that have been subjected to vacuum and hot air (through-drying) prior to being adhered to the crepe dryer. The sidedness is present even after treatment with a softener. A premium one-ply tissue should not only have a high overall softness level, but should also exhibit softness of each side approaching the softness of the other.

The most pertinent prior art patents will be discussed but, in our view, none of them can be fairly said to apply to a one-ply tissue of this invention which exhibits high thickness, soft, strong and low sidedness attributes. U.S. Pat. No. 4,447,294, issued to Osborne, Ill., relates to towels and facial tissues and discloses a process for making a towel or facial tissue product having high wet strength and low dry strength. This reference requires that the wet strength agent be at least partially cured and that a debonding agent be applied to the already-dried web, which further distinguishes that reference from the present invention. Phan et al., in U.S. Pat. No. 5,262,007 discloses towels, napkins, and tissue papers containing biodegradable softening compound, a temporary wet strength resin, and a wetting agent. The Phan reference requires the use of a wetting agent, presumably to restore the absorbency lost by use of the softening agent The present invention is unrelated to the Phan reference and does not require use of a wetting agent to achieved a one-ply bathroom tissue having high absorbency. In U.S. Pat. No. 5,164,045, Awofeso et al. disclose a soft, high bulk tissue. However, production of this product requires stratified foam forming and a furnish that contains a substantial amount of anfractuous and mechanical bulking fibers, none of which are necessary to the present invention. U.S. Pat. No. 5,695, 607 discloses a low sidedness product, but the tissue does not have the high thickness and temporary wet strength agent of the present invention. U.S. patent application Ser. No. **(case 1930) does not disclose mated embossing and the resulting product does not have as high a cross direction stretch or cross direction tensile energy absorbed for a given base sheet cross direction stretch and tensile energy absorbed. In addition, production of this product requires such strategies as fiber and/or chemical stratification that have been found unnecessary to produce the product of the present invention. Dunning et al., U.S. Pat. No. 4,166,001, discloses a double creped three-layered product having a weak middle layer. The Dunning product does not suggest the novel one-ply premium softness soft tissue of this invention and does not contain a temporary wet strength agent. The foregoing prior art references do not disclose or suggest a high-softness, strong one-ply tissue having low sidedness and having a total tensile strength of no more than 75 grams per three inches per pound per ream basis weight, A cross-machine direction stretch of at least 5.0 percent wherein the ratio of embossed product stretch to that of the base sheet is at least about 1.4, a cross direction wet tensile strength of at least 2.7 grams per three inches per pound per ream of basis weight, a tensile stiffness of less than about 1.1 grams per inch per percent strain per pound per ream basis weight, a GM friction deviation of no more than 0.225 and a sidedness parameter less than 0.275 usually in the range of about 0.180 to about 0.250.

SUMMARY OF THE INVENTION

The novel premium quality high-softness, single-ply tissue having a very low "sidedness" along with excellent softness, coupled with strength is advantageously obtained by using a combination of four processing steps.

Suitably, the premium softness, strong, low sidedness bathroom tissue has been prepared by utilizing techniques falling into four categories: (i) providing a web having basis weight of at least 15 pounds for each 3,000 square foot ream; (ii) adding to the web or to the furnish controlled amounts of a temporary wet strength agent and a softener/debonder; (iii) low angle, high adhesion creping using suitable high strength nitrogen containing organic adhesives and a crepe angle of less than 85 degrees, the relative speeds of the Yankee dryer and a reel being controlled to produce a product MD stretch of at least 15%; and (iv) embossing the tissue between mated emboss rolls, each of which has both male and female elements. The furnish may include a mixture of softwood, hardwood, and recycled fiber. The premium softness and strong single-ply tissue having low sidedness may be suitably obtained from a homogenous former or from two-layer, three-layer, or multi-layer stratified formers.

Further advantages of the invention will be set forth in part in the description which follows. The advantages of the invention may be realized and attained by means of the instrumentalities and combinations particularly pointed out in the appended claims.

To achieve the foregoing advantages and in accordance with the purpose of the invention as embodied and broadly described herein, there is disclosed:

A method of making an absorbent high-softness, high-basis weight, single-ply tissue comprising:

(a) providing a fibrous pulp of papermaking fibers;

(b) forming a nascent web from said pulp, wherein said web has a basis weight of at least about 15 lbs./3,000 sq. ft. ream;

(c) including in said web at least about 3 lbs./ton of a temporary wet strength agent and up to 10 lbs./ton of a nitrogen containing softener; optionally a cationic nitrogen containing softener;

(d) dewatering said web;

(e) adhering said web to a Yankee dryer;

(f) creping said web from said Yankee dryer using a creping angle of less than 85 degrees, wherein the relative speeds between said Yankee dryer and the take-up reel is controlled to produce a final product MD stretch of at least about 15%;

(g) optionally calendering said web;

(h) embossing said web between mated emboss rolls, each of which contains both male and female elements;

(i) forming a single-ply web wherein steps (a)–(f) and (h) and optionally step (g) are controlled to result in a single-ply tissue product having a total tensile strength of no more than 75 grams per three inches per pound per ream basis weight, a cross direction wet tensile strength of at least 2.7 grams per three inches per pound per ream of basis weight, a tensile stiffness of no more than about 1.1 grams per inch per percent strain per pound per ream basis weight, a ratio of product cross direction stretch to base sheet cross direction stretch of at least about 1.4, a GM friction deviation of no more than 0.225 and a sidedness parameter less than 0.275 usually in the range of about 0.180 to about 0.250.

There is also disclosed a single-ply tissue produced by a wet pressing technique, having a total tensile strength of no more than 75 grams per three inches per pound per ream basis weight, a cross direction wet tensile strength of at least 2.7 grams per three inches per pound per ream of basis weight, a tensile stiffness of no more than about 1.1 grams per inch per percent strain per pound per ream basis weight, a ratio of product cross direction stretch to base sheet cross direction stretch of at least about 1.4, a GM friction deviation of no more than 0.225 and a sidedness parameter less than 0.275 usually in the range of about 0.180 to about 0.250.

BRIEF DESCRIPTION OF THE DRAWINGS

The present invention will become more fully understood from the detailed description given hereinbelow and the accompanying drawings which are given by way of illustration only and thus are not limiting of the present invention.

FIGS. 4*a*–4*d* illustrates another emboss pattern according to the present invention.

DETAILED DESCRIPTION OF THE PREFERRED EMBODIMENTS

Figure 1:
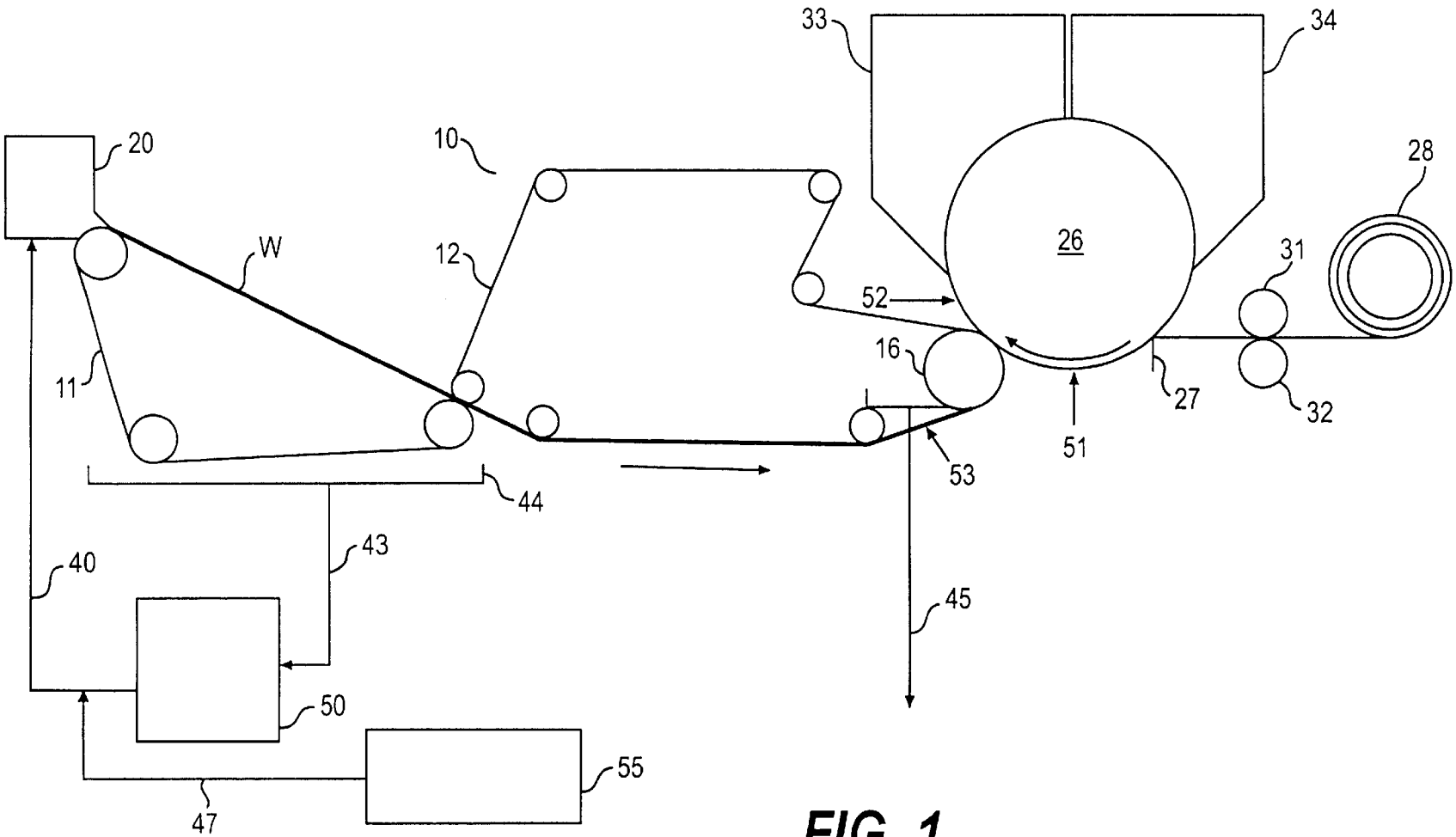
FIG. 1 is a schematic flow diagram of the papermaking process showing suitable points of addition of chargeless temporary wet strength chemical moieties, and optionally, starch and softener/debonder.

The paper products of the present invention, e.g., single-ply tissue having one, two, three, or more layers, may be manufactured on any papermaking machine of conventional forming configurations such as fourdrinier, twin-wire, suction breast roll, or crescent forming configurations. FIG. 1 illustrates an embodiment of the present invention wherein machine chest (55) is used for preparing the papermaking furnish. Functional chemicals such as dry strength agents, temporary wet strength agents and softening agents may be added to the furnish in the machine chest (55) or in conduit (47). The furnish may be treated sequentially with chemicals having different functionality depending on the character of the fibers that constitute the furnish, particularly their fiber length and coarseness, and depending on the precise balance of properties desired in the final product. The furnish is diluted to a low consistency, typically 0.5% or less, and transported through conduit (40) to headbox (20) of a paper machine (10). FIG. 1 includes a web-forming end or wet end with a liquid permeable foraminous forming fabric (11) which may be of any conventional configuration A wet nascent web (W) is formed in the process by ejecting the dilute furnish from headbox (20) onto forming fabric (11). The web is dewatered by drainage through the forming fabric, and additionally by such devices as drainage foils and vacuum devices (not shown). The water that drains through the forming fabric may be collected in savall (44) and returned to the papermaking process through conduit (43) to. silo (50), from where it again mixes with the furnish coming from machine chest (55).

From forming fabric (11), the wet web is transferred to felt (12). Additional dewatering of the wet web may be provided prior to thermal drying, typically by employing a nonthermal dewatering means. This nonthermal dewatering is usually accomplished by various means for imparting mechanical compaction to the web, such as vacuum boxes, slot boxes, contacting press rolls, or combinations thereof. The wet nascent web (W) is carried by the felt (12) to the pressing roll (16) where the wet nascent web (w) is transferred to the drum of a Yankee dryer (26). Fluid is pressed from the wet web (W) by pressing roll (16) as the web is transferred to the drum of the Yankee dryer (26) at a fiber consistency of at least about 5% up to about 50%, preferably about 35 to about 50%. The web is then dried by contact with the heated Yankee dryer and by impingement of hot air onto the sheet, said hot air being supplied by hoods (33) and (34). The web is then creped from the dryer by means of a creping blade (27). The finished web may optionally be pressed between calender rolls (31) and (32) and is then collected on a take-up roll (28).

Adhesion of the partially dewatered web to the Yankee dryer surface is facilitated by the mechanical compressive action exerted thereon, generally using one or more pressing rolls (16) that form a nip in combination with thermal drying means (26). This brings the web into more uniform contact with the thermal drying surface. The attachment of the web to the Yankee dryer may be assisted and the degree of adhesion between the web and the dryer controlled by application of various creping aids that either promote or inhibit adhesion between the web and the dryer (26). These creping aids are usually applied to the surface of the dryer (26) at position (51), prior to its contacting the web.

Also shown in FIG. 1 are the location for applying functional chemicals to the already-formed cellulosic web. According to one embodiment of the process of the invention, the temporary wet strength agent can be applied directly on the Yankee (26) at position (51) prior to application of the web thereto. In another preferred embodiment, the wet strength agent can be applied from position (52) or (53) on the air-side of the web or on the Yankee side of the web respectively. Softeners are suitably sprayed on the air side of the web from position (52) or on the Yankee side from position (53) as shown in FIG. 1. The softener/debonder can also be added to the furnish prior to its introduction to the headbox (20). Again, when a starch based temporary wet strength agent is added, it should be added to the furnish prior to web formation. The softener may be added either before or after the starch has been added, depending on the balance of softness and strength attributes desired in the final product. In general, charged temporary wet strength agents are added to the furnish prior to its being formed into a web, while uncharged temporary wet strength agents are added to the already formed web as shown in FIG. 1.

Papermaking fibers used to form the soft absorbent, single-ply products of the present invention include cellulosic fibers commonly referred to as wood pulp fibers, liberated in the pulping process from softwood (gymnosperms or coniferous trees) and hardwoods (angiosperms or deciduous trees). Cellulosic fibers from diverse material origins may be used to form the web of the present invention, including non-woody fibers liberated from sugar cane, bagasse, sabai grass, rice straw, banana leaves, paper mulberry (i.e, bast fiber), abaca leaves, pineapple leaves, esparto grass leaves, and fibers from the genus Hesperaloe in the family Agavaceae. Also recycled fibers which may contain any of the above fibers sources in different percentages can be used in the present invention. Suitable fibers are disclosed in U.S. Pat. Nos. 5,320,710 and 3,620,911, both of which are incorporated herein by reference.

Papermaking fibers can be liberated from their source material by any one of the number of chemical pulping processes familiar to one experienced in the art including sulfate, sulfite, polysulfite, soda pulping, etc. The pulp can be bleached if desired by chemical means including the use of chlorine, chlorine dioxide, oxygen, etc. Furthermore, papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if one wishes, by a number of familiar bleaching schemes including alkaline peroxide and ozone bleaching. The type of furnish is less critical than is the case for prior art products. A significant advantage of our process over the prior art processes is that coarse hardwoods and softwoods and significant amounts of recycled fiber can be utilized to create a soft product in our process while prior art one-ply products had to utilize more expensive low-coarseness softwoods and low-coarseness hardwoods such as eucalyptus.

To reach the attributes needed for a premium tissue product, the tissue of the present invention should be treated with a temporary wet strength agent. It is believed that the inclusion of the temporary wet strength agent allows the product to hold up in use despite its relatively low level of dry strength, which is necessary to achieve the desired high softness level in a conventional wet-pressed one-ply product. Therefore, products having a suitable level of temporary wet strength will generally be perceived as being stronger and thicker in use than will similar products having low wet strength values. Suitable wet strength agents comprise an organic moiety and suitably include water soluble aliphatic dialdehydes or commercially available water soluble organic polymers comprising aldehydic units, and cationic starches containing aldehyde moieties. These agents may be used singly or in combination with each other.

Suitable temporary wet strength agents are aliphatic and aromatic aldehydes including glyoxal, malonic dialdehyde, succinic dialdehyde, glutaraldehyde, dialdehyde starches, polymeric reaction products of monomers or polymers having aldehyde groups and optionally nitrogen groups. Representative nitrogen containing polymers which can suitably be reacted with the aldehyde containing monomers or polymers include vinyl-amides, acrylamides and related nitrogen containing polymers. These polymers impart a positive charge to the aldehyde containing reaction product. In addition, other commercially available temporary wet strength agents such as Parez 745 manufactured by Cytec can be used, along with those disclosed, for example, in U.S. Pat. No. 4,605,702.

We have found that condensates prepared from dialdehydes such as glyoxal or cyclic urea and polyol both containing aldehyde moieties are useful for producing temporary wet strength. Since these condensates do not have a charge, they are added to the web as shown in FIG. 1 before or after the pressing roll (16) or charged directly on the Yankee surface. Suitably these temporary wet strength agents are sprayed on the air side of the web prior to drying on the Yankee as shown in FIG. 1 from position (52).

The preparation of cyclic ureas is disclosed in U.S. Pat. No. 4,625,029 herein incorporated by reference in its entirety. Other U.S. Patents of interest disclosing reaction products of dialdehydes with polyols include U.S. Pat. Nos. 4,656,296; 4,547,580; and 4,537,634 and are also incorporated into this application by reference in their entirety. The dialdehyde moieties expressed in the polyols render the whole polyol useful as a temporary wet strength agent in the manufacture of one-ply tissue according to the present invention. Suitable polyols are reaction products of dialdehydes such as glyoxal with polyols having at least a third hydroxyl group. Glycerin, sorbitol, dextrose, glycerin monoacrylate, and glycerin monomaleic acid ester are representative polyols useful as temporary wet strength agents.

Polysaccharide aldehyde derivatives are suitable for use in the manufacture of tissue according to the present invention. The polysaccharide aldehydes are disclosed in U.S. Pat. Nos. 4,983,748 and 4,675,394. These patents are incorporated by reference into this application. Suitable polysaccharide aldehydes have the following structure:

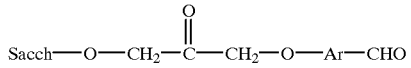

wherein Ar is an aryl group. This cationic starch is a representative cationic moiety suitable for use in the manufacture of the tissue of the present invention and can be charged with the furnish.

A starch of this type can also be used without other aldehyde moieties but, in general, should be used in combination with a cationic softer.

Our novel tissue can suitably include polymers having non-nucleophilic water soluble nitrogen heterocyclic moieties in addition to aldehyde moieties. Representative resins of this type are:

A. Temporary wet strength polymers comprising aldehyde groups and having the formula:

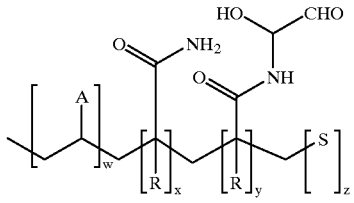

wherein A is a polar, non-nucleophilic unit which does not cause said resin polymer, to become water-insoluble; B is a hydrophilic, cationic unit which imparts a positive charge to the resin polymer; each R is H, $C_1$–C4 alkyl or halogen; wherein the mole percent of W is from about 58% to about 95%; the mole percent of X is from about 3% to about 65%; the mole percent of Y is from about 1% to about 20%; and the mole percent from Z is from about 1w% to about 10%; said resin polymer having a molecular weight of from about 5,000 to about 200,000.

B. Water soluble cationic temporary wet strength polymers having aldehyde units which have molecular weights of from about 20,000 to about 200,000, and are of the formula:

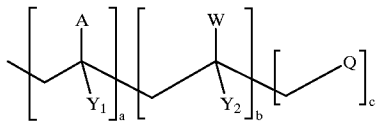

wherein A is

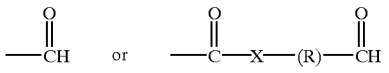

and X is —O—, —NH—, or —$NCH_3$— and R is a substituted or unsubstituted aliphatic group; $Y_1$ and $Y_2$ are independently —H, —$CH_3$, or a halogen, such as Cl or F; W is a nonnucleophilic, water-soluble nitrogen heterocyclic moiety; and Q is a cationic monomeric unit. The mole percent of "a" ranges from about 30% to about 70%, the mole percent of "b" ranges from about 30% to about 70%, and the mole percent of "c" ranges from about 1% to about 40%.

The temporary wet strength resin may be any one of a variety of water soluble organic polymers comprising aldehydic units and cationic units used to increase the dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769; and 5,217,576. Among the preferred temporary wet strength resins that may be used in practice of the present invention are modified starches sold under the trademarks Co-Bond® 1000 and Co-Bond® 1000 Plus by National Starch and Chemical Company of Bridgewater, New Jersey. Prior to use, the cationic aldehydic water soluble polymer is prepared by preheating an aqueous slurry of approximately 5% solids maintained at a temperature of approximately 240° Fahrenheit and a pH of about 2.7 for approximately 3.5 minutes. Finally, the slurry is quenched and diluted by adding water to produce a mixture of approximately 1.0% solids at less than about 130° F.

Co-Bond® 1000 is a commercially available temporary wet strength resin including an aldehydic group on cationic corn waxy hybrid starch. The hypothesized structure of the molecules are set forth as follows:

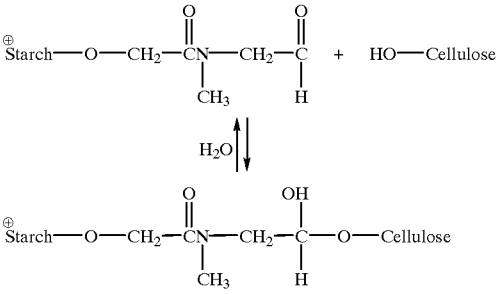

Other preferred temporary wet strength resins, also available from the National Starch and Chemical company are sold under the trademark Co-Bond® 1600 and CoBond® 2300. These starches are supplied as aqueous colloidal dispersions and do not require preheating prior to use. In addition, other commercially available temporary wet strength agents such as Parez 745 manufactured by Cytec can be used, as well as those disclosed in U.S. Pat. No. 4,605,702.

In addition to the temporary wet strength agent, the one-ply tissue also contains one or more softeners. These softeners are suitably nitrogen containing organic compounds preferably cationic nitrogenous softeners and may be selected from trivalent and tetravalent cationic organic nitrogen compounds incorporating long fatty acid chains; compounds including imidazolines, amino acid salts, linear amine amides, tetravalent or quaternary ammonium salts, or mixtures of the foregoing. Other suitable softeners include the amphoteric softeners which may consist of mixtures of such compounds as lecithin, polyethylene glycol (PEG), castor oil, and lanolin.

The present invention may be used with a particular class of softener materials—amido amine salts derived from partially acid neutralized amines. Such materials are disclosed in U.S. Pat. No. 4,720,383; column 3, lines 40–41. Also relevant are the following articles: Evans, *Chemistry and Industry*, Jul. 5, 1969, pp. 893–903; Egan, J. *Am. Oil Chemist's Soc.*, Vol. 55 (1978), pp. 118–121; and Trivedi et al, *J. Am. Oil Chemist's Soc.*, June 1981, pp. 754–756. All of the above are incorporated herein by reference. As indicated therein, softeners are often available commercially only as complex mixtures rather than as single compounds. While this discussion will focus on the predominant species, it should be understood that commercially available mixtures would generally be used to practice.

The softener having a charge, usually cationic softeners, can be supplied to the furnish prior to web formation, applied directly onto the partially dewatered web or may be applied by both methods in combination. Alternatively, the softener may be applied to the completely dried, creped sheet, either on the paper machine or during the converting process. Softeners having no charge are applied at the dry end of the paper making process.

The softener employed for treatment of the furnish is provided at a treatment level that is sufficient to impart a perceptible degree of softness to the paper product but less than an amount that would cause significant runnability and sheet strength problems in the final commercial product. The amount of softener employed, on a 100% active basis, is suitably from about 1.0 pound per ton of furnish up to about 10 pounds per ton of furnish; preferably from about 2 to about 7 pounds per ton of furnish.

Imidazoline-based softeners that are added to the furnish prior to its formation into a web have been found to be particularly effective in producing soft tissue products and constitute a preferred embodiment of this invention. Of particular utility for producing the soft tissue product of this invention are the cold-water dispersible imidazolines. These imidazolines are mixed with alcohols or diols, which render the usually insoluble imidazolines water dispersible. Representative initially water insoluble imidazolines rendered water soluble by the water soluble alcohol or diol treatment include Witco Corporation's Arosurf PA 806 and DPSC 43/13 which are water dispersible versions of tallow and oleic-based imidazolines, respectively.

Treatment of the partially dewatered web with the softener can be accomplished by various means. For instance, the treatment step can comprise spraying, as shown in FIG. 1, applying with a direct contact applicator means, or by employing an applicator felt. It is often preferred to supply the softener to the air side of the web from position 52 shown in FIG. 1, so as to avoid chemical contamination of the paper making process. It has been found in practice that a softener applied to the web from either position 52 or position 53 shown in FIG. 1 penetrates the entire web and uniformly treats it.

Useful softeners for spray application include softeners having the following structure:

$$[(RCO)_2EDA]HX$$

wherein EDA is a diethylenetriamine residue, R is the residue of a fatty acid having from 12 to 22 carbon atoms, and X is an anion or $[(RCONHCH_2CH_2)_2NR']HX$ wherein R is the residue of a fatty acid having from 12 to 22 carbon atoms, R' is a lower alkyl group, and X is an anion.

More specifically, preferred softeners for application to the partially dewatered web are Quasoft® 218, 202, and 209-JR made by Quaker Chemical Corporation which contain a mixture of linear amine amides and imidazolines Another suitable softener is a dialkyl dimethyl fatty quaternary ammonium compound of the following structure:

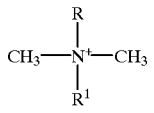

wherein R and $R^1$ are the same or different and are aliphatic hydrocarbons having fourteen to twenty carbon atoms preferably the hydrocarbons are selected from the following: $C_{16}H_{35}$ and $C_{18}H_{37}$.

A new class of softeners are imidazolines which have a melting point of about 0–40° C. in aliphatic diols, alkoxylated aliphatic diols, or a mixture of aliphatic diols and alkoxylated aliphatic diols. These are useful in the manufacture of the tissues of this invention. The imidazoline moiety in aliphatic polyols, aliphatic diols, alkoxylated aliphatic polyols, alkoxylated aliphatic diols or in a mixture of these compounds, functions as a softener and is dispersible in water at a temperature of about 1° C. to about 40° C. The imidazoline moiety is of the formula:

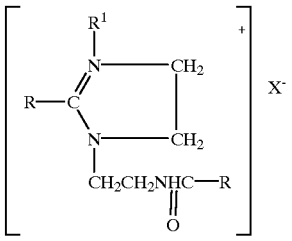

wherein X is an anion and R is selected from the group of saturated and unsaturated parafinic moieties having a carbon chain of $C_{12}$ to $C_{20}$ and $R_1$ is selected from the groups of methyl and ethyl moieties. Suitably the anion is methyl sulfate of the chloride moiety The preferred carbon chain length is $C_{12}$ to $C_{18}$. The preferred diol is 2,2,4 trimethyl 1,3 pentane diol and the preferred alkoxylated diol is ethoxylated 2,2,4 trimethyl 1,3 pentane diol. A commercially available example of the type of softener is AROSURF® PA 806 manufactured by Witco Corporation of Ohio.

The web is dewatered preferably by an overall compaction process. The web is then preferably adhered to a Yankee dryer. The adhesive is added directly to the metal of the Yankee, and advantageously, it is sprayed directly on the surface of the Yankee dryer drum. Any suitable art recognized adhesive may be used on the Yankee dryer. Suitable adhesives are widely described in the patent literature. A comprehensive but nonexhaustive list includes U.S. Pat. Nos. 5,246,544; 4,304,625; 4,064,213; 4,501,640; 4,528,316; 4,883,564; 4,684,439; 4,886,579; 5,374,334; 5,382,323; 4,094,718; and 5,281,307. Adhesives such as glyoxylated polyacrylamide, and polyaminoamides have been shown to provide high adhesion and are particularly suited for use in manufacture of the one-ply product. The preparation of the polyaminoarnide resins is disclosed in U.S. Pat. No. 3,761,354 which is incorporated herein by reference. The preparation of polyacrylamide adhesives is disclosed in U.S. Pat. No. 4,217,425 which is incorporated herein by reference. Typical release agents can be used in accordance with the present invention; however, the amount of release, should one be used at all, will often be below traditional levels.

The web is then creped from the Yankee dryer and optionally calendered. It is necessary that the product of the present invention have a relatively high machine direction stretch. The final product's machine direction stretch should be at least about 15%, preferably at least about 18%. Usually the base sheets machine direction stretch is controlled by fixing the percent crepe and the finished products' cross direction stretch is impacted by the embossing of the current invention. The relative speeds between the Yankee dryer and the reel are controlled such that a reel crepe of at least about 18%, more preferably at least 20%, and most preferably at least 25% is maintained. Creping is preferably carried out at a creping angle of from about 65 to about 85 degrees, preferably about 70 to about 80 degrees, and more preferably about 75 degrees. The creping angle is defined as the angle formed between the surface of the creping blade's edge and a line tangent to the Yankee dryer at the point at which the creping blade contacts the dryer, assuming a rigid blade.

Figure 2:
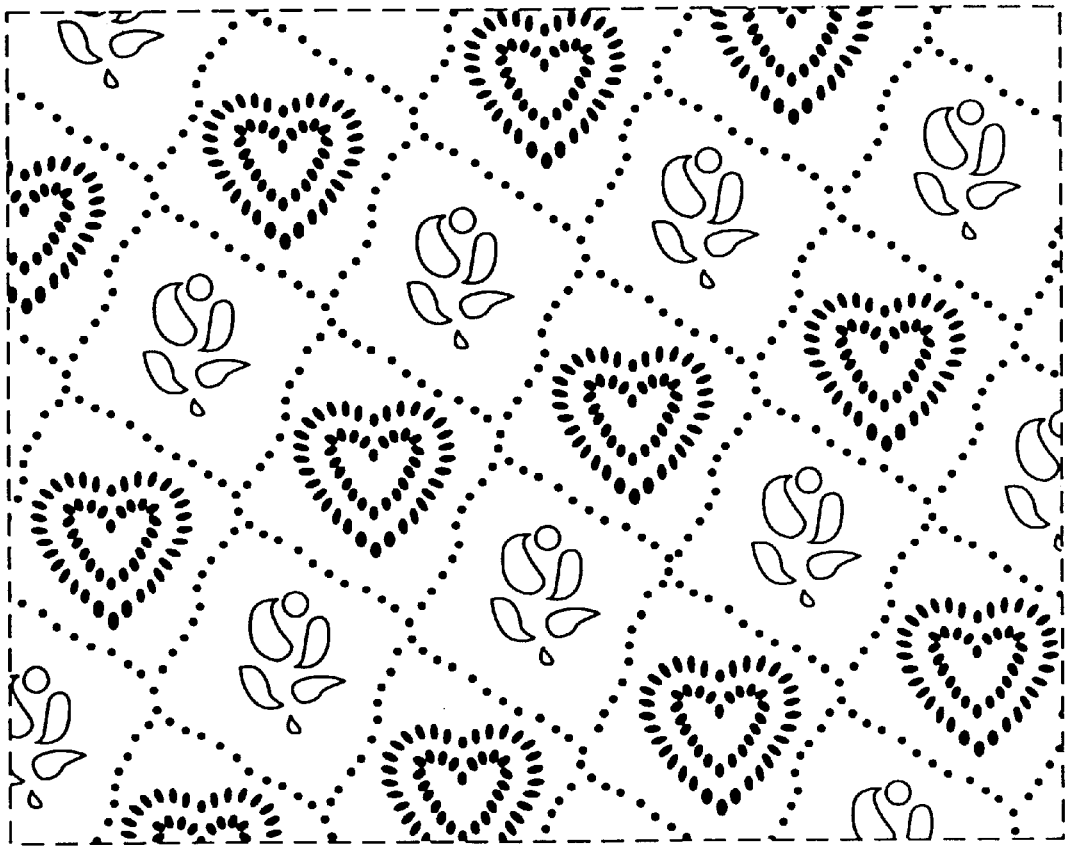
FIG. 2 illustrates a prior art emboss pattern.

In the prior art, the typical tissue embossing process involves the compression and stretching of the flat tissue base sheet between a relatively soft (40 Shore A) roll and a hard roll which has relatively large "macro" signature emboss elements (FIG. 2). This embossing improves the aesthetics of the tissue and the structure of the tissue roll. However, the thickness of the base sheet between the signature emboss elements is actually reduced. This lowers the perceived bulk of a conventional wet press (CWP) one-ply product made by this process. Also, this process makes the tissue two-sided, as the male emboss elements create protrusions or knobs on only one side of the sheet.

Smaller, closely spaced "micro" elements can be added to the emboss pattern to improve the perceived bulk of the rubber to steel embossed product. However, this results in a harsh product. This is because small elements in a conventional process create many small, stiff protrusions on one side of the tissue, resulting in a high roughness.

The problems of high friction and sidedness associated with the prior art can be minimized by the embossing process of the present invention.

Figure 7:
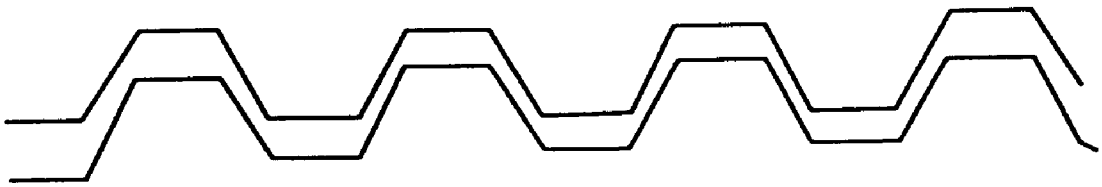
FIG. 7 illustrates the engagement of mated emboss rolls according to the present invention.

In the process of the present invention, the tissue is embossed between two hard rolls each of which contain both micro male and female elements although some signature on macro elements can be present. The micro male elements of one emboss roll are engaged or mated with the female elements of another mirror image emboss roll as can be seen in FIG. 7. These emboss rolls can be made of materials such as steel or very hard rubber. In this process, the base sheet is only compressed between the sidewalls of the male and female elements. Therefore, base sheet thickness is preserved and bulk perception of a one-ply product is much improved. Also, the density and texture of the pattern improves bulk perception. This mated process and pattern also creates a softer tissue because the top of the tissue protrusions remain soft and uncompressed.

The male elements of the emboss pattern are non-discrete, that is, they are not completely surrounded by flat land area. There are approximately an equal number of male and female elements on each emboss roll. This increases the perceived bulk of the product and makes both sides of the emboss tissue symmetrical and equally pleasing to the touch.

Another advantage of the present invention is the type of textured surface that is created. This texture provides for better cleansing of the skin than a typically embossed CWP one-ply tissue which is very smooth in the unembossed areas. The surface of the CWP product of the present invention is better than that of a typical through-air-dried (TAD) product in that it has texture but more uniformly bonded fibers. Therefore the fibers on the surface of the tissue do not pill or ball up, especially when the tissue becomes wet. In contrast, there are significant portions of the typical textured TAD tissue surface where fibers are weakly bonded. These fibers tend to pill when the tissue becomes wet, even when a significant amount of wet strength has been added to the fibers.

Figure 3A:
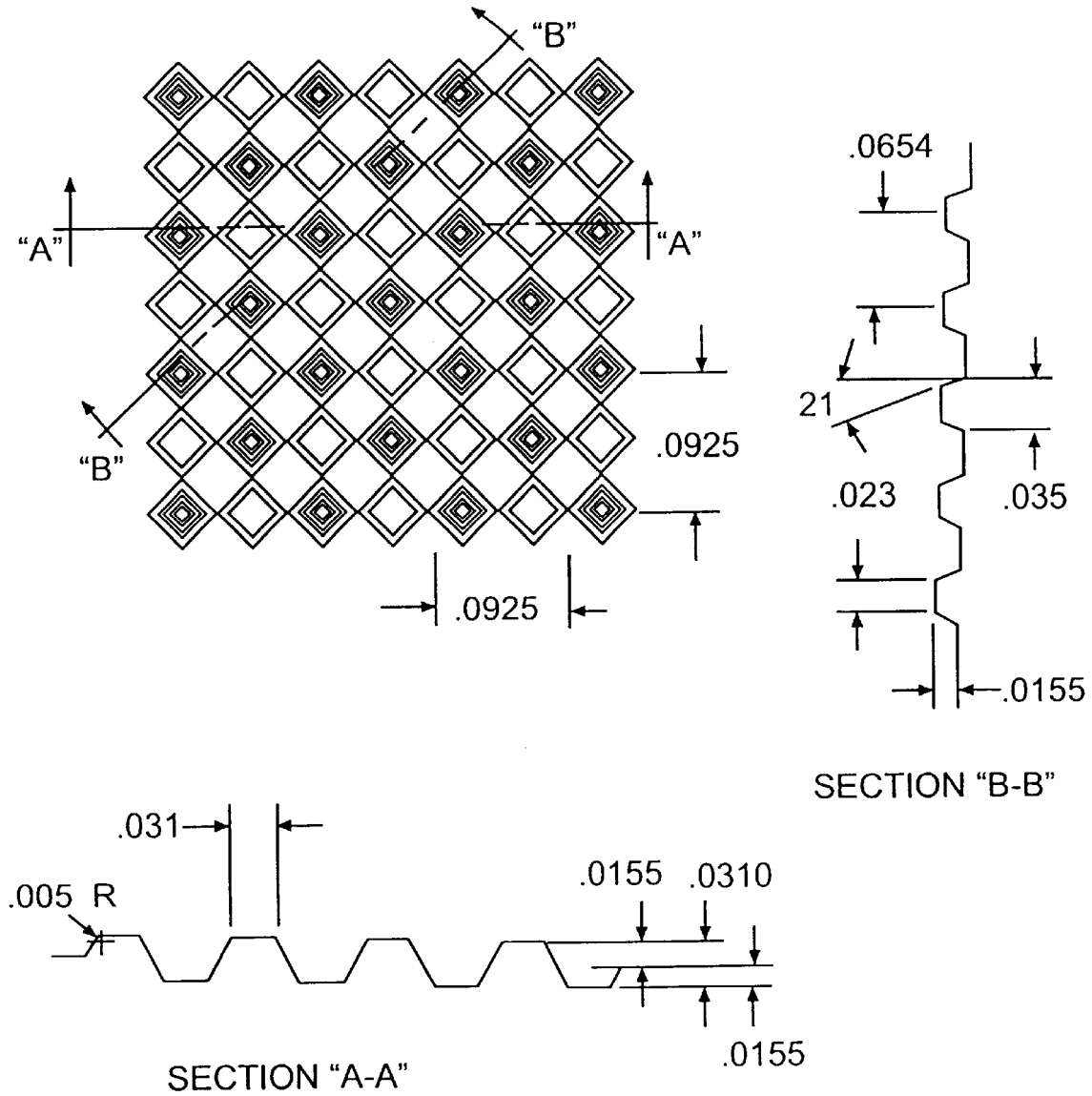
FIGS. 3*a*–3*b* illustrates one emboss pattern according to the present invention.
Figure 3B:
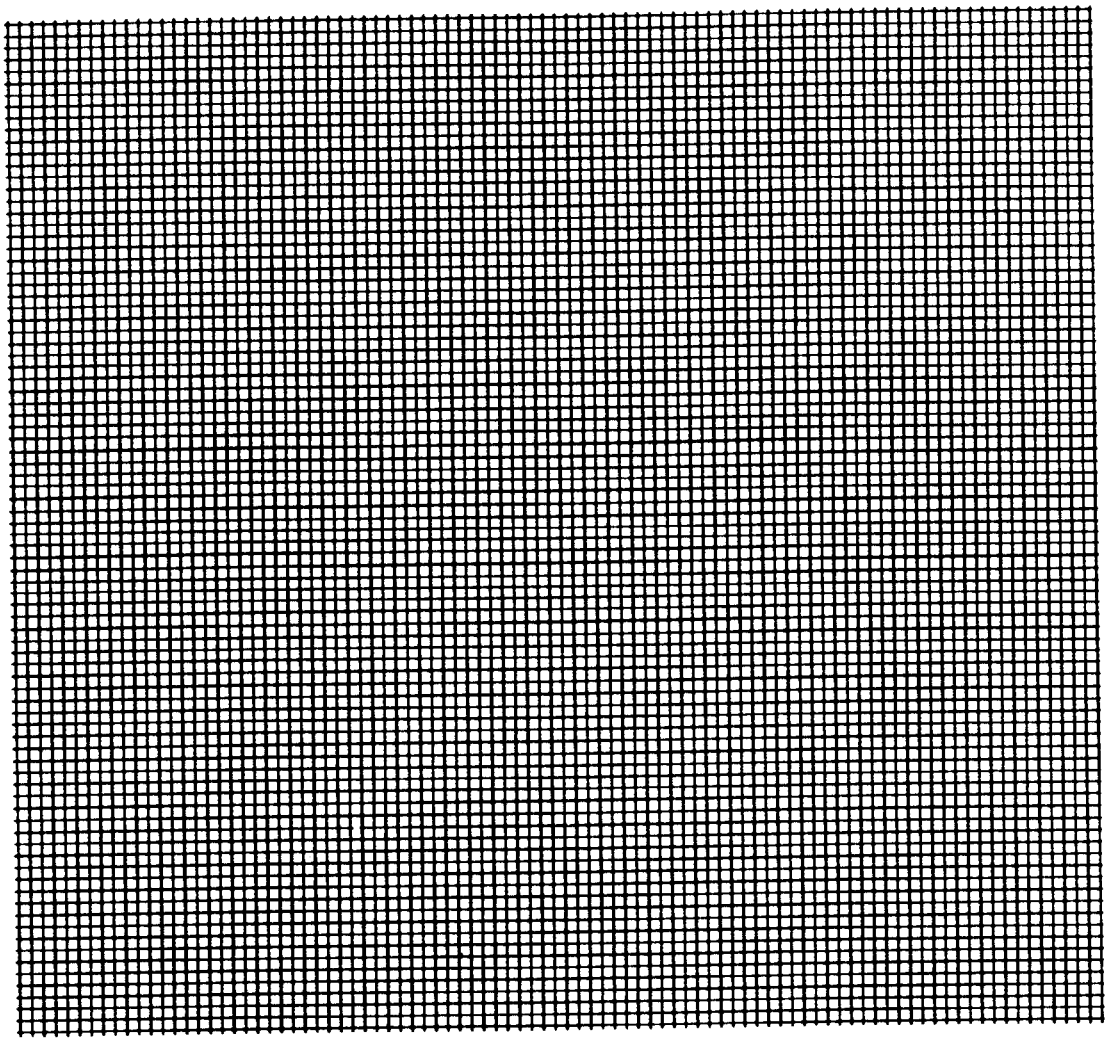

A preferred emboss pattern for the present invention is shown in FIG. 3. It contains diamond shaped male,.female and mid-plane elements which all have a preferred width of 0.023 inches. The width is preferably between about 0.005 inches and about 0.070 inches, more preferably between about 0.015 inches and about 0.045 inches, most preferably between about 0.025 inches and about 0.035 inches. The shape of the elements can be selected as circles, squares or other easily understood shapes. When a micro and macro pattern are used, the distance between the end of the macroelements and the start of the microelements is preferably between about 0.007 inches and about 1 inch, more preferably between about 0.005 and about 0.045, and most preferably between about 0.010 and about 0.035. The height of the male elements above the mid-plane is preferably about 0.0155 inches and the depth of the female elements is preferably about 0.0155 inches. The angle of the sidewalls of the elements is preferably between about 10 and about 30 degrees, more preferably between about 18 and about 23 degrees, most preferably about 21 degrees. In a most preferred embodiments, the elements are about 50% male and about 50% female.

Patterns such as those shown in FIG. 3 can be combined with one or more signature emboss patterns to create products of the present invention. Signature bosses are made up of any emboss design and are often a design which is related by consumer perception to the particular manufacturer of the tissue.

More preferred emboss patterns for the present invention are shown in FIGS. 4*a* and 4*b*. These patterns are exact mirror images of one another. These emboss patterns combine the diamond micro pattern in FIG. 3 with a large, signature or "macro" patter. This combination pattern provides aesthetic appeal from the macro pattern as well as the improvement in perceived bulk and texture created by the micro pattern. The macro portion of the pattern is mated so that it does not reduce softness by increasing the friction on the back side of the sheet. In addition to providing improved aesthetics, this pattern minimizes nesting (the complete overlap of embossing elements) and improves roll structure by increasing the repeat length for the pattern from 0.0925 inches to 5.0892 inches.

The design of the macroelements in the more preferred emboss pattern preserves strength of the tissue. This is done by starting the base of the male macroelements at the mid-plane of the microelements as shown in FIG. 4*b*. The female macroelements are started at the mid-plane of the microelements as shown in FIG. 4*a*. This reduces the stretching of the sheet from the mid-plane by 50%. However, because the macroelements are still 31 mils in height or depth, they still provide a crisp, clearly defined pattern.

The more preferred emboss pattern has the bases of male microelements and the opening of female microelements kept at least 0.014 inches away from the base of male macroelements or openings of female macroelements. This prevents the emboss rolls from plugging with tissue.

Figure 4C:
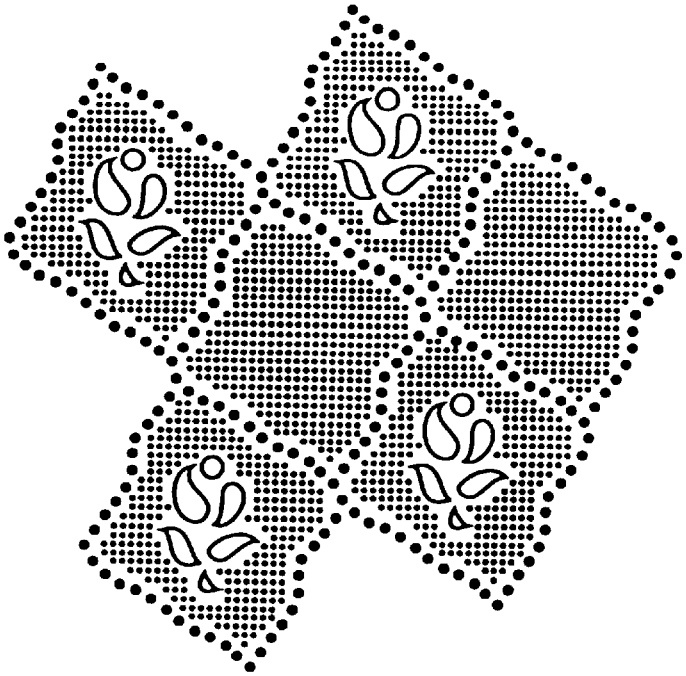
Figure 4D:
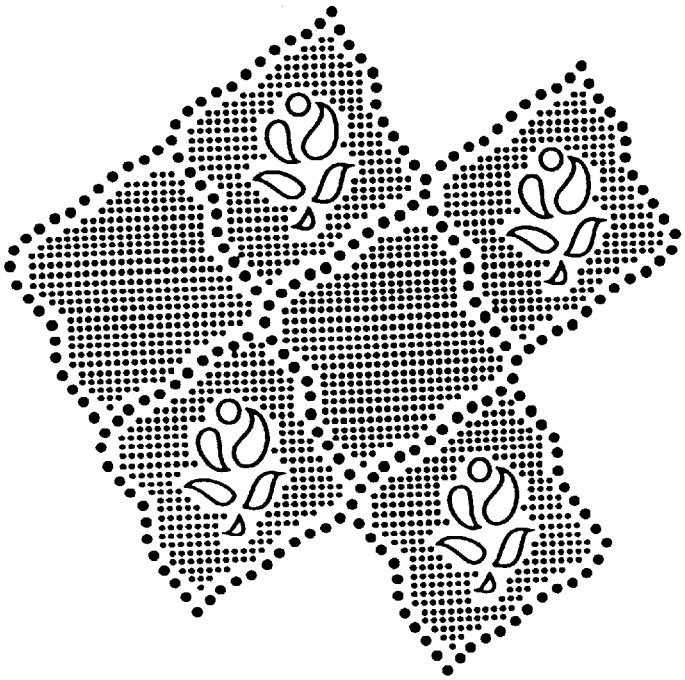

It is also possible to put some of the male macroelements going one direction and the rest of them going the other direction. This may further reduce any sidedness in the product. FIGS. 4*c* and 4*d* show the actual size of the preferred patterns.

The basis weight of the single ply tissue is desirably from about 15 to about 25 lbs./3,000 sq. ft. ream, preferably from about 17 to about 20 lbs./ream. The caliper of the tissue of the present invention may be measured using the Model II Electronic Thickness Tester available from the Thwing-Albert Instrument Company of Philadelphia, Pennsylvania. The caliper is measured on a sample consisting of a stack of eight sheets of tissue using a two-inch diameter anvil at a 539±10 gram dead weight load. Single-ply tissues of the present invention have a specific (normalized for basis weight) caliper after calendering and embossing of from about 2.6 to 4.2 mils per 8 plies of tissue sheets per pound per ream, the more preferred tissues having a caliper of from about 2.8 to about 4.0, the most preferred tissues have a caliper of from about 3.0 to about 3.8. In the papermaking art, it is known that caliper is dependent on the number of sheets and the size of the roll desired in the final product.

Tensile strength of tissue produced in accordance with the present invention is measured in the machine direction and cross-machine direction on an Instron Model 4000: Series IX tensile tester with the gauge length set to 4 inches. The area of tissue tested is assumed to be 3 inches wide by 4 inches long. In practice, the length of the samples is the distance between lines of perforation in the case of machine direction tensile strength and the width of the samples is the width of the roll in the case of cross-machine direction tensile strength. A 20 pound load cell with heavyweight grips applied to the total width of the sample is employed. The maximum load is recorded for each direction. The results are reported in units of "grams per 3-inch"; a more complete rendering of the units would be "grams per 3-inch by 4-inch strip." The total (sum of machine and cross machine directions) dry tensile of the present invention, when normalized for basis weight, will be between 40 and 75 grams per 3 inches per pound per ream. The ratio of MD to CD tensile is also important and should be between 1.0 and 2.75, preferably between 1.25 and 2.5.

The CD stretch (also referred to as % elongation) is determined during the procedure for measuring tensile strength described above and is defined as the maximum elongation of the sample prior to failure. We have found that the emboss process of the current invention results in an increased CD stretch as compared with prior art emboss processes. This higher CD stretch results in a more flexible product and one having a lower tensile stiffness in the cross machine direction. This lower CD stiffness is of particular importance for one-ply CWP products as the CD tensile stiffness is typically much higher than that of the machine direction and controls the overall product stiffness level. The CD stretch of products made according to the current invention should be at least 5 percent, with the ratio of the finished product CD stretch to that of the base sheet being at least 1.2.

Tensile energy absorption (TEA), which is defined as the area under the load/elongation (stress/strain) curve, is also measured during the procedure for measuring tensile strength. Tensile energy absorption is related to the perceived strength of the product in use. Products having a higher TEA may be perceived by users as being stronger than similar products that have lower TEA values, even if the actual tensile strength of the two products are the same. In fact, having a higher tensile energy absorption may allow a product to be perceived as being stronger than one with lower TEA, even if the tensile strength of the high-TEA product is less than that of the product having the lower tensile energy absorption.

The wet tensile of the tissue of the present invention is measured using a three-inch wide strip of tissue that is folded into a loop, clamped in a special fixture termed a Finch Cup, then immersed in a water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time. The wet tensile of the present invention will be at least 2.75 grams per three inches per pound per ream in the cross direction as measured using the Finch Cup. Normally, only the cross direction wet tensile is tested, as the strength in this direction is normally lower than that of the machine direction and the tissue is more likely to fail in use in the cross direction.

Softness is a quality that does not lend itself to easy quantification. J. D. Bates, in "Softness Index: Fact or Mirage?" TAPPI, Vol. 48 (1965), No. 4, pp. 63A–64A, indicates that the two most important readily quantifiable properties for predicting perceived softness are (a) roughness and (b) what may be referred to as stiffness modulus. Tissue produced according to the present invention has a more pleasing texture as measured by sidedness parameter or reduced values of either or both roughness and stiffness modulus (relative to control samples). Surface roughness can be evaluated by measuring geometric mean deviation in the coefficient of friction (GM MMD) using a Kawabata KES-SE Friction Tester equipped with a fingerprint-type sensing unit using the low sensitivity range. A 25 g stylus weight is used, and the instrument readout is divided by 20 to obtain the mean deviation in the coefficient of friction. The geometric mean deviation in the coefficient of friction or overall surface friction is then the square root of the product of the deviation in the machine direction and the cross-machine direction. The GM MMD of the single-ply product of the current invention is preferably no more than about 0.225, is more preferably less than about 0.215, and is most preferably about 0.150 to about 0.205. The tensile stiffness (also referred to as stiffness modulus) is determined by the procedure for measuring tensile strength described above, except that a sample width of 1 inch is used and the modulus recorded is the geometric mean of the ratio of 50 grams load over percent strain obtained from the load-strain curve. The specific tensile stiffness of said web is preferably from about 0.5 to about 1.2 g/inch/% strain per pound of basis weight and more preferably from about 0.6 to about 1.0 g/inch/ % strain per pound of basis weight, most preferably from about 0.7 to about 0.8 g/inch/ % strain per pound of basis weight To quantify the degree of sidedness of a single-ply tissue, we use a quantity which we term sidedness parameter or S. We define sidedness parameter S as $$S = \frac{1}{2}\frac{[GMMMD]_H}{[GMMMD]_L}\{[GMMMD]_H + [GMMMD]_L\}$$

where $[\text{GM MMD}]_H$ and $[\text{GM MMD}]_L$ are the geometric mean friction deviations or overall surface friction of the two sides of the sheet. The "H" and "L" subscripts refer the higher and lower values of the friction deviation of the two sides—that is the larger friction deviation value is always placed in the numerator. For most creped products, the air side friction deviation will be higher than the friction deviation of the Yankee side.

S takes into account not only the relative difference between the two sides of the sheet but also the overall friction level. Accordingly, low S values are preferred. The sidedness(s) of the one-ply product should be from about 0.160 to about 0.275; preferably less than about 0.250; and more preferably less than about 0.225.

Formation of tissues of the present invention, as represented by Kajaani Formation Index Number, should be at least about 50, preferably about 55, more preferably at least about 60, and most preferably at least about 65, as determined by measurement of transmitted light intensity variations over the area of the sheet using a Kajaani Paperlab 1 Formation Analyzer which compares the transmitivity of about 250,000 subregions of the sheet. The Kajaani Formation Index Number, which varies between about 20 and 122, is widely used through the paper industry and is for practical purposes identical to the Robotest Number which is simply an older term for the same measurement.

TAPPI 401 OM-88 (Revised 1988) provides a procedure for the identification of the types of fibers present in a sample of paper or paperboard and an estimate of their quantity. Analysis of the amount of the softener/debonder chemicals retained on the tissue paper can be performed by any method accepted in the applicable art. For the most sensitive cases, we prefer to use x-ray photoelectron spectroscopy ESCA to measure nitrogen levels, the amounts in each level being measurable by using the tape pull procedure described above combined with ESCA analysis of each "split." Normally the background level is quite high and the variation between measurements quite high, so use of several replicates in a relatively modern ESCA system such as at the Pekin Elmer Corporation's model 5,600 is required to obtain more precise measurements. The level of cationic nitrogenous softener/debonder such as Quasoft®202-JR can alternatively be determined by solvent extraction of the Quasoft®202-JR by an organic solvent followed by liquid chromatography determination of the softener/debonder. TAPPI 419 OM-85 provides the qualitative and quantitative methods for measuring total starch content However, this procedure does not provide for the determination of starches that are cationic, substituted, grafted, or combined with resins. These types of starches can be determined by high pressure liquid chromatography. (TAPPI, Journal Vol. 76, Number 3.)

The following examples are not to be construed as limiting the invention as described herein.

EXAMPLE 1

One-ply tissue base sheets made from a variety of furnish blends were embossed using both prior art technology and the technology of the current invention. The prior art emboss pattern is shown in FIG. 2 while the pattern used to produce products of the current invention is shown in FIG. 3. The base sheets were embossed to produce finished products having similar strength levels. The specific furnish blends and embossed product tissue strengths are shown in Table 1. The total tensile is defined as the sum of the machine direction and cross direction tensile strengths, while the specific total tensile is the ratio of the total tensile and the basis weight.

TABLE 1

One-Ply Tissue Products

| Product # | Furnish Blend | Emboss Technology | Basis Weight (lb/ream) | Total Tensile (gm/3") | Specific Total Tensile (gm/3"/lb/rm) |
|---|---|---|---|---|---|
| 1 | 2/1 Northern Hardwood/Northern Softwood | Prior Art | 19.4 | 911 | 47.0 |
| 2 | 2/1 Northern Hardwood/Northern Softwood | Current Invention | 18.6 | 843 | 45.3 |
| 3 | 2/1 Northern Hardwood/Southern Softwood | Prior Art | 18.8 | 844 | 44.9 |
| 4 | 2/1 Northern Hardwood/Southern Softwood | Current Invention | 18.5 | 891 | 48.2 |
| 5 | 1/1 Northern Hardwood/Southern Softwood | Prior Art | 18.1 | 1054 | 58.2 |
| 6 | 1/1 Northern Hardwood/Southern Softwood | Current Invention | 17.5 | 1097 | 62.7 |

Figure 6:
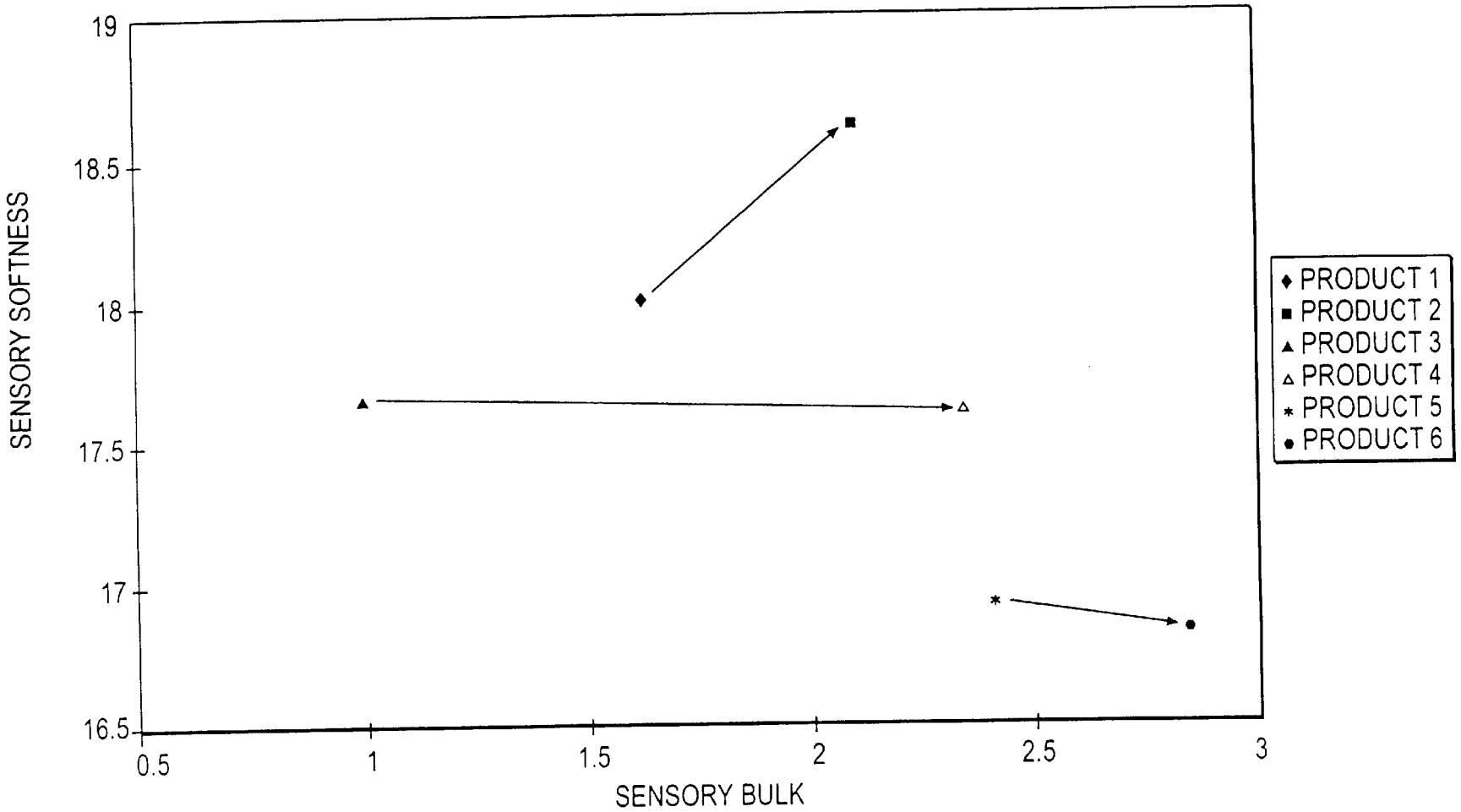
FIG. 6 is a graphical representation of sensory softness versus sensory bulk.

The products shown in Table 1 were tested for sensory softness and sensory bulk by a trained sensory panel. The results of these tests are shown in FIG. 6. The arrows in the figure are used to connect products made from the same base sheet, As can be seen from the figure, the sensory softness of the two products made from a given base sheet are roughly equal, while, for each pair, the tissue product of the current invention has greater sensory bulk than does the product of the prior art. The differences for each pair are statistically significant at the 95% confidence level.

EXAMPLE 2

A one-ply tissue base sheet was made on a crescent former paper machine from a furnish containing 10% Northern Softwood Kraft, 40% Southern Hardwood Kraft, and 50% Secondary Fiber. Twelve pounds per ton of a modified cationic starch (CoBond® 1600) was applied to the furnish to provide temporary wet strength. The furnish was also treated with 3.5 pounds per ton of an imidazoline-based softener (Arosurft® PA 806) to control tensile strength and impart softness. Two and one-half pounds per ton of a spray softener (Quasoft® 209JR) was applied to the sheet while it was on a pressing felt. The sheet was creped from the Yankee dryer at a moisture content of 4 percent. The crepe angle was 73.5 degrees and the percent reel crepe was 25%. The sheet was calendered such that the caliper of the uncalendered tissue base sheet was reduced by approximately 20–25%. The physical properties of the tissue base sheet are shown in Table 2.

TABLE 2

One-Ply Base Sheet Physical Properties

| Basis Weight (lbs/ream) | Caliper (mils/8 sht) | Machine Direction Tensile (grams/3 in) | Cross Direction Tensile (grams/3 in) | Machine Direction Stretch (%) | Cross Direction Stretch (%) | Cross Direction Wet Tensile (grams/3 in) | Tensile Modulus (grams/in/% strain) | Friction Deviation |
|---|---|---|---|---|---|---|---|---|
| 19.4 | 45.4 | 840 | 640 | 29.9 | 5.3 | 89 | 22.4 | 0.170 |

The base sheet was converted to a singleply tissue product by embossing the base sheet using standard embossing. The sheet was embossed between a hard roll that had been engraved with the emboss pattern shown in FIG. 2 and a soft roll (Shore A hardness=40). The emboss depth was 0.100". The product was wound to produce finished tissue rolls having 280—4.5"×4.5"—tissue sheets per roll. The finished single-ply product was tested for physical properties and for sensory softness by a trained panel. The results of these tests are shown in Table 3.

TABLE 3

Physical Properties and Sensory Softness of Embossed One-Ply Tissue Product-Prior Art

| Basis Weight (lbs/ream) | Caliper (mils/8 sht) | Machine Direction Tensile (grams/3 in) | Cross Direction Tensile (grams/3 in) | Machine Direction Stretch % | Cross Direction Stretch % | Cross Direction Wet Tensile (grams/3 in) | Tensile Modulus (grams/in/% strain) | Friction Deviation |
|---|---|---|---|---|---|---|---|---|
| 18.7 | 69.2 | 634 | 369 | 22.5 | 5.5 | 69 | 13.9 | 0.184 |

| Machine Direction TEA (g/mm) | Cross Direction TEA (g/mm) | Sensory Softness | Specific Caliper (mils/8 sht/lb/ream) | Specific Total Tensile (gr/3"/lb/ream) | Specific CD Wet Tensile (gr/3"/lb/ream) | Specific Tensile Modulus (gr/in/% strain/lb/ream) |
|---|---|---|---|---|---|---|
| 0.942 | 0.134 | 16.07 | 3.70 | 53.6 | 3.69 | 0.74 |

The sensory softness value of the embossed product is well below that of a premium quality tissue product. This result is believed to be based in part on the high level of Southern Hardwood and Secondary Fiber contained in the tissue's furnish, both of which are known to be disadvantageous in producing soft one-ply tissue products.

The base sheet was also embossed using the mated emboss technology of the current invention. The sheet was embossed between two engraved hard rolls. The pattern used is shown in FIG. 4. The emboss gap between the emboss sleeves was 0.014 inches. After embossing the sheet was calendered between the emboss unit's feed rolls which were set to a gap of 0.006 inches. This step was necessary to control the product's roil diameter to the desired level. The finished tissue product had 280 sheets, each measuring 4.5"×4.5". The finished products were tested for physical properties and for softness by a trained sensory panel. The results of these tests are shown in Table 4.

TABLE 4

Physical Properties and Sensory Softness of Embossed One-Ply Tissue Product-Current invention

| Basis Weight (lbs/ream) | Caliper (mils/8 sht) | Machine Direction Tensile (grams/3 in) | Cross Direction Tensile (grams/3 in) | Machine Direction Stretch % | Cross Direction Stretch % | Cross Direction Wet Tensile (grams/3 in) | Tensile Modulus (grams/in/% strain) | Friction Deviation |
|---|---|---|---|---|---|---|---|---|
| 18.6 | 67.1 | 625 | 356 | 20.6 | 6.9 | 64 | 13.2 | 0.200 |

| Machine Direction TEA (g/mm) | Cross Direction TEA (g/mm) | Sensory Softness | Specific Caliper (mils/8 sht/lb/ream) | Specific Total Tensile (gr/3"/lb/ream) | Specific CD Wet Tensile (gr/3"/lb/ream) | Specific Tensile Modulus (gr/in/% strain/lb/ream) |
|---|---|---|---|---|---|---|
| 0.712 | 0.154 | 17.30 | 3.61 | 52.7 | 3.44 | 0.71 |

As can be seen by comparing the values in Tables 3 and 4, the physical properties of the two products are quite similar. However, the sensory softness of the product made according to the current invention is much higher than that of the prior art product and is in the range of premium tissue products, demonstrating that the current invention provides a way to produce conventional wet-press one-ply tissue products having premium softness levels from fiber blends that are known to be inimical to producing soft tissue products using any tissue making process.

EXAMPLE 3

As has been shown in the previous example, it is difficult, using the prior art, to produce a soft, CWP one-ply product from a furnish containing high percentages of coarse Southern fiber and/or recycled fiber. Because of this difficulty, most premium tissue products made from these furnish types have been produced in a two-ply format. In order to compare the one-ply product of the current invention with two-ply technology a two-ply tissue product of similar basis weight to that of the one-ply tissue products; was produced using the same furnish blend. For the two-ply product, no temporary wet strength agent or softening compounds were added to the furnish, as these chemicals are not typically included in two-ply tissue products. The tissue base sheet was creped from the Yankee dryer at a moisture content of 4%, a percent crepe of 20% and creping angle of 73.5 degrees. The base sheets were calendered to a targeted caliper of 29 mils/8 sheets.

Figure 5:
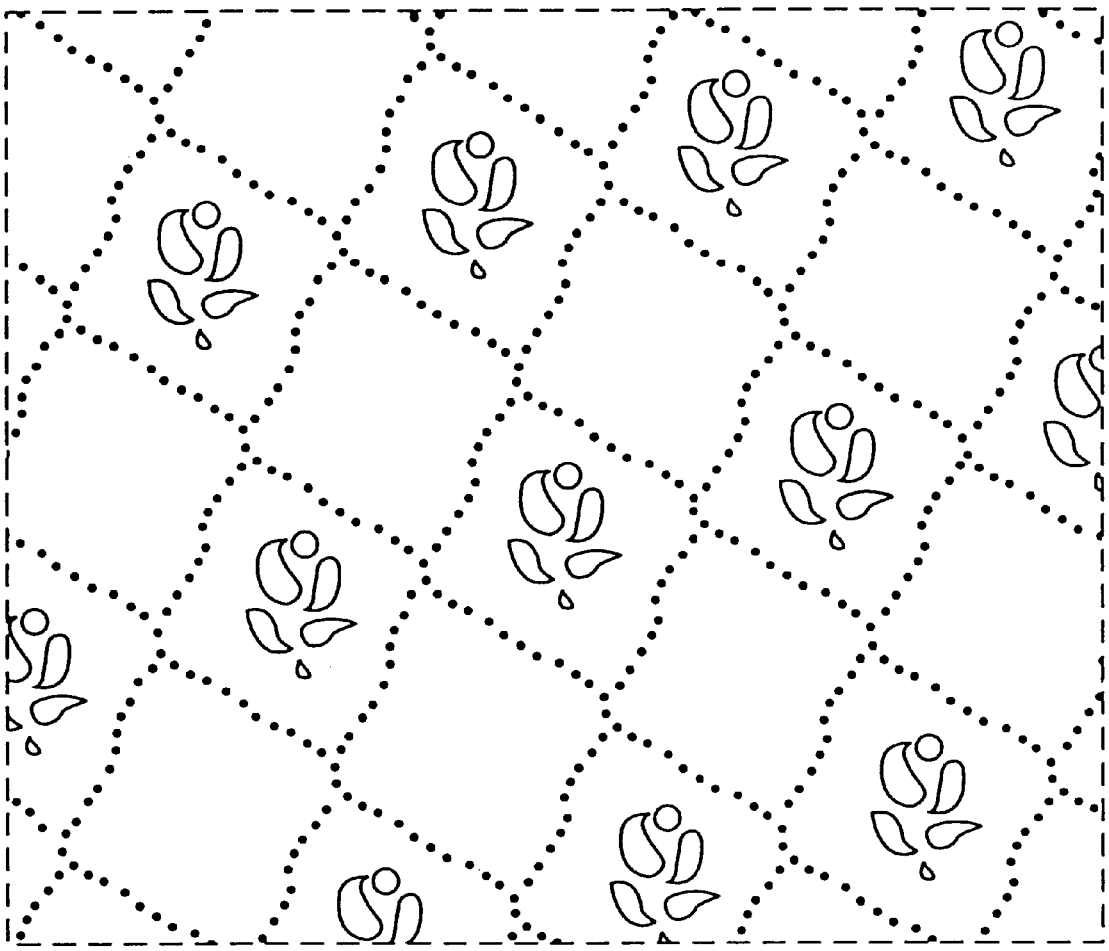
FIG. 5 illustrates another prior art emboss pattern.

Two base sheets were plied together and embossed to produce a two-ply tissue product using the emboss pattern shown in FIG. 5. The tissues were plied such that the air sides of the two base sheets faced each other on the inside of the product. This plying strategy insures that the softer Yankee sides of the two-ply product are the only sides that are contacted by the user. The plied base sheets were embossed using conventional embossing technology in which the sheets were embossed between an engraved hard roll and a soft (Shore A hardness=40) roll. The emboss depth was 0.080 inches. The product was wound to produce finished tissue rolls having 280—4.5"×4.5"—two-ply tissue sheets per roll. The finished product was tested for physical properties and for sensory softness by a trained panel. The results of these tests are shown in Table 5. The wet tensile strength was not measured for this product because it contained no temporary wet strength agent and its wet tensile would be expected to be so low as to be of no practical significance (less than 40 grams/3 inches in the cross direction).

TABLE 5

Physical Properties and Sensory Softness of Embossed One-Ply Tissue Product

| Basis Weight (lbs/ream) | Caliper (mils/8 sht) | Machine Direction Tensile (grams/3 in) | Cross Direction Tensile (grams/3 in) | Machine Direction Stretch % | Cross Direction Stretch % | Cross Direction Wet Tensile (grams/3 in) | Tensile Modulus (grams/in/% strain) | Friction Deviation |
|---|---|---|---|---|---|---|---|---|
| 18.2 | 69.1 | 1024 | 411 | 16.3 | 6.7 | — | 17.4 | 0.162 |

| Machine Direction TEA (g/mm) | Cross Direction TEA (g/mm) | Sensory Softness | Specific Caliper (mils/8 sht/lb/ream) | Specific Total Tensile (gr/3"/lb/ream) | Specific CD Wet Tensile (gr/3"/lb/ream) | Specific Tensile Modulus (gr/in/% strain/lb/ream) |
|---|---|---|---|---|---|---|
| 1.060 | 0.176 | 17.44 | 3.79 | 78.8 | — | 0.96 |

As can be seen by comparing this data with that from Tables 3 and 4, the sensory softness of the two-ply product is only slightly above that of the one-ply product made using the current invention, while both of these products have softness values well above that of the prior-art one-ply tissue product. The difference in sensory softness between the two-ply and the current invention one-ply product is not statistically significant (95% confidence limit), while the differences between the softness values of the present invention and that of the one ply tissue made using the prior art are statistically significant at the same confidence limit

EXAMPLE 4

The product of the current invention exhibits higher embossed CD stretch as compared to products embossed using prior art technology. This higher CD stretch results in a more flexible product and one having a lower tensile stiffness in the cross machine direction. This lower CD stiffness is of particular importance for one-ply CWP products as the CD tensile stiffness is typically much higher than that of the machine direction and controls the overall product stiffness level.

Figure 8:
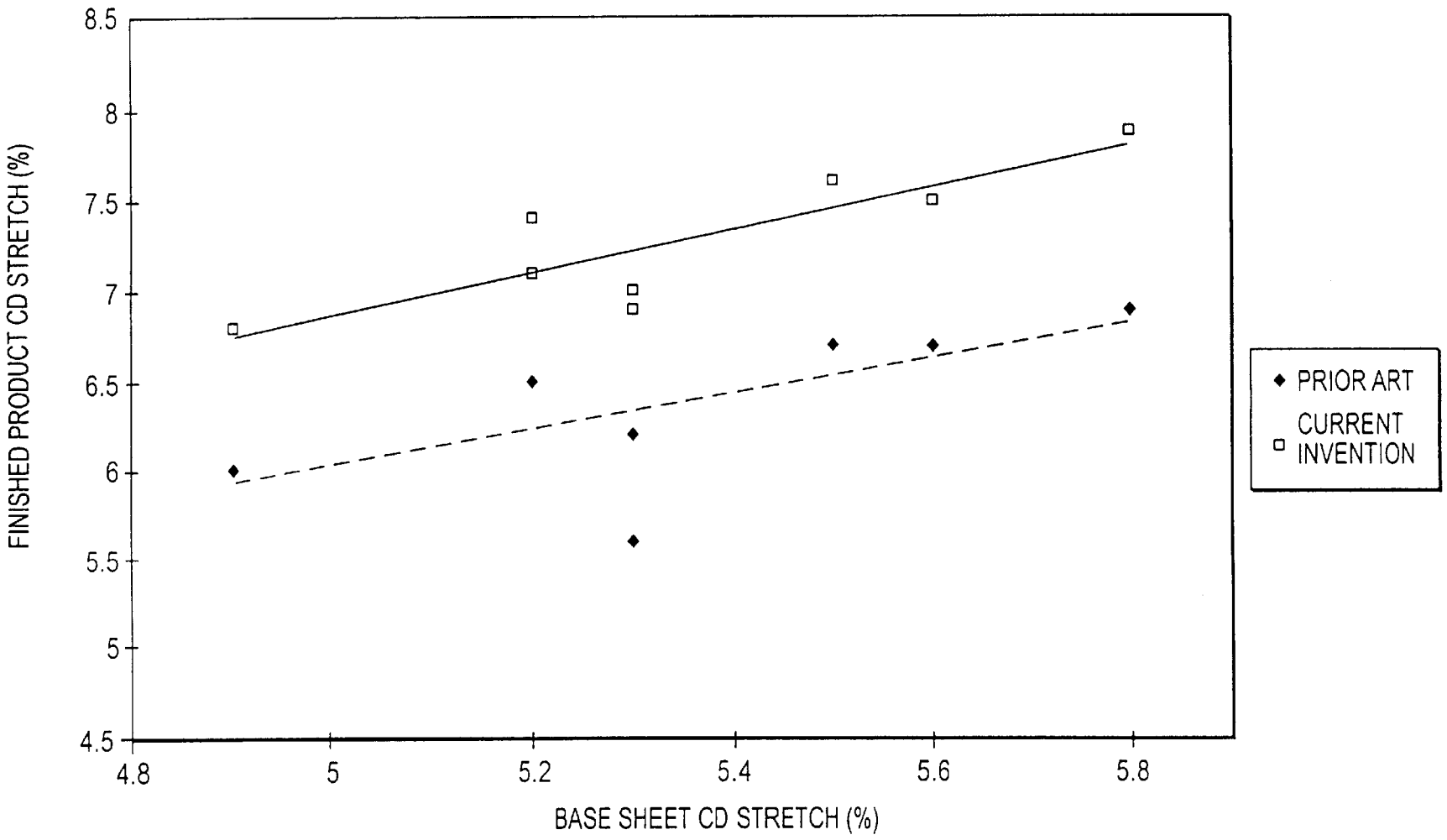
FIG. 8 is a graphical representation of the % CD stretch in the finished product and the % CD stretch in the base sheet.

Eight one-ply tissue base sheets having a variety of furnish blends were made on a crescent former paper machine. These base sheets were each embossed using conventional emboss technology and the technology of the current invention as described in Example 2. The physical properties of the base sheets and finished products were measured. FIG. 8 shows the CD stretch of the embossed tissues as a function of their base sheet CD stretches. The figure shows that the emboss technology of the current invention provides an increased CD stretch as compared with that of the prior art.

Figure 9:
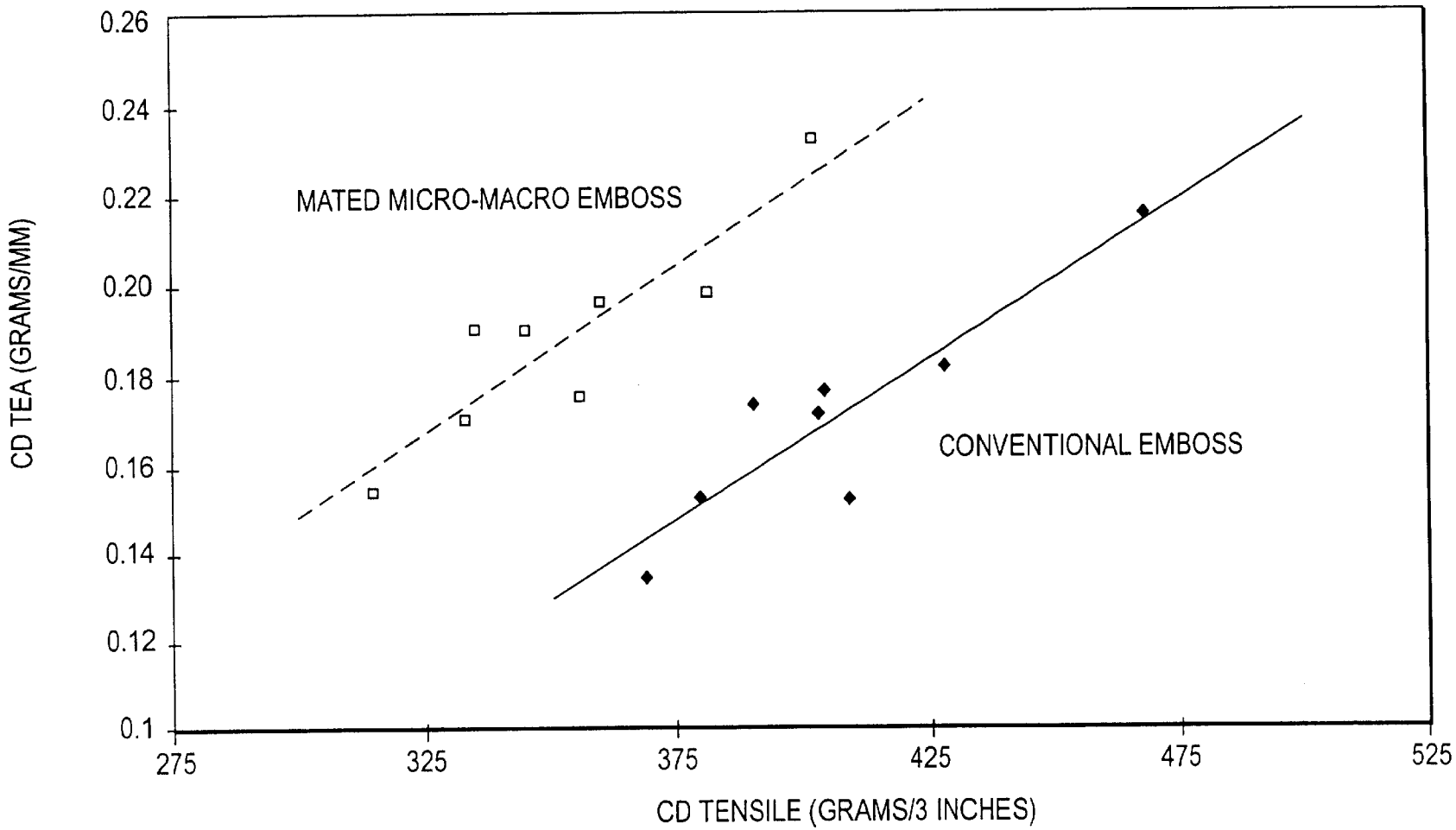
FIG. 9 is a graphical representation of the % CD tensile energy absorption and; the CD tensile strength of the finished product.

FIG. 9 compares the CD TEA of the same eight pairs of products as a function of the tissues' CD tensile. It can be seen that, at similar values of CD tensile strength, the products of the present invention have a higher CD tensile energy absorption than do those that employed the prior art. This improved CD tea should correlate to an improvement in perceived strength in use.

EXAMPLE 5

A one-ply CWP tissue base sheet was produced on a commercial tissue machine from a furnish containing 10% Northern Softwood Kraft, 40% Southern Hardwood Kraft, and 50% Secondary Fiber. The furnish was treated with 10 pounds per ton of a temporary wet strength starch (Co-Bond 1600) to impart wet strength and 4 pounds per ton of a imidazoline-based debonder (Arosurf PA 806) to control the base sheet tensile. Two pounds per ton of a softener (Quasoft 218 JR) was sprayed onto the sheet while it was on the felt. The sheet was creped from the Yankee dryer at a moisture content of four percent using 24 percent reel crepe. The base sheet was also embossed using the mated emboss technology of the current invention. The sheet was embossed between two engraved hard rolls and employed the pattern shown in FIG. 4. The emboss gap between the emboss rolls was 0.013 inches. The emboss unit's feed rolls were set to have a gap of 0.013 inches. The product was wound to produce rolls that contained 280 sheets, each measuring 4.5×4.5 inches. The physical properties and sensory softness of this embossed product are shown in Table 6. In addition, the same base sheet was embossed using the mated emboss process to produce a product having a sheet count of 560, with each sheet measuring 4.5×4.5 inches. For this product, the gap between the emboss rolls was 0.014 inches and the emboss unit's feed rolls were set at a gap of 0.004 inches. The physical properties and sensory softness of this product are also shown in Table 6.

TABLE 6

Physical Properties and Sensory Softness of Embossed One-Ply Tissue Products

| Sheet Count | Basis Weight (lbs/ream) | Caliper (mils/8 sht) | Machine Direction Tensile (grams/3 in) | Cross Direction Tensile (grams/3 in) | Machine Direction Stretch (%) | Cross Direction Stretch (%) | Cross Direction Wet Tensile (grams/3 in) | Tensile Stiffness (grams/in/% strain) |
|---|---|---|---|---|---|---|---|---|
| 280 | 18.3 | 67.2 | 569 | 320 | 21.8 | 5.1 | 78 | 13.6 |
| 560 | 18.2 | 53.7 | 670 | 335 | 22.7 | 5.3 | 83 | 15.9 |

| Friction Deviation | Machine Direction TEA (g/mm) | Cross Direction TEA (g/mm) | Sensory Softness | Specific Caliper (mils/8 sht/lb/ream) | Specific Total Tensile (gr/3"/lb/ream) | Specific CD Wet Tensile (gr/3"/lb/ream) | Specific Tensile Stiffness (gr/in/% strain/lb/ream) |
|---|---|---|---|---|---|---|---|
| 0.214 | 0.776 | 0.113 | 17.02 | 3.67 | 48.6 | 4.26 | 0.74 |
| 0.223 | 0.917 | 0.122 | 16.99 | 2.95 | 55.2 | 4.56 | 0.87 |

The one-ply tissue product described above was tested in a Monadic Home Use Test to determine the reaction of consumers to the product. Also tested were commercial (store-shelf two-ply CWP products that were produced at the same mill as was the one-ply product. The two-ply products were embossed using conventional emboss technology and were made to both 280 and 560 sheet counts. The physical properties and sensory softness of the commercial two-ply products are shown in Table 7.

TABLE 7

Physical Properties and Sensory Softness of Embossed Two-Ply Tissue Products

| Sheet Count | Basis Weight (lbs/ream) | Caliper (mils/8 sht) | Machine Direction Tensile (grams/3 in) | Cross Direction Tensile (grams/3 in) | Machine Direction Stretch (%) | Cross Direction Stretch (%) | Cross Direction Wet Tensile (grams/3 in) | Tensile Stiffness (grams/in/% strain) |
|---|---|---|---|---|---|---|---|---|
| 280 | 18.6 | 66.7 | 1056 | 375 | 13.8 | 5.7 | 22 | 23.3 |
| 560 | 18.6 | 55.5 | 1029 | 403 | 12.6 | 5.2 | 22 | 31.0 |

| Friction Deviation | Machine Direction TEA (g/mm) | Cross Direction TEA (g/mm) | Sensory Softness | Specific Caliper (mils/8 sht/lb/ream) | Specific Total Tensile (gr/3"/lb/ream) | Specific CD Wet Tensile (gr/3"/lb/ream) | Specific Tensile Stiffness (gr/in/% strain/lb/ream) |
|---|---|---|---|---|---|---|---|
| 1.192 | 1.036 | 0.155 | 16.87 | 3.59 | 76.9 | 1.18 | 1.25 |
| 0.183 | 0.938 | 0.144 | 17.77 | 2.98 | 77.0 | 1.18 | 1.67 |

In a Monadic Home Use Test, participants are asked to rate a single product as to its overall quality and for several key tissue attributes. The product can be rated as "Excellent," "Very Good," "Good," "Fair," or "Poor" for overall performance and for each attribute. To compare products that have been consumer tested in this way, a numerical value is assigned to each response. The values range from a 5 for an "Excellent" rating to a 1 for a "Poor" rating. This assignment allows an average rating (between 1 and 5) to be calculated for the product in each attribute area and for overall performance. Table 8 shows the results of the Monadic Home Use tests for overall performance and for several important tissue attributes for the one- and two-ply products described above. These results show that for both 280 and 560-count tissues, the one-ply products produced in accordance with the current invention are equivalent in overall quality and for important tissue attributes to the commercially-marketed two-ply tissues.

TABLE 8

Monadic Use Test Results for One- and Two Ply Products

| Product | Overall Rating | Softness | Strength | Thickness | Absorbency |
|---|---|---|---|---|---|
| 1-ply, 280 count | 3.64 | 3.90 | 3.82 | 3.55 | 3.84 |
| 2-ply, 280 count | 3.47 | 3.79 | 3.81 | 3.37 | 3.84 |
| 1-ply, 560 count | 3.69 | 3.84 | 3.99 | 3.60 | 3.93 |
| 2-ply, 560 count | 3.78 | 3.77 | 3.74 | 3.60 | 3.75 |

Other embodiments of the invention will be apparent to those skilled in the art from consideration of the specification and practice of the invention disclosed herein, It is intended that the specification and examples be considered as exemplary only with the true scope and spirit of the invention being indicated by the following claims.

We claim:

1. A mated embossed single-ply tissue produced from a wet pressed sheet, having an approximately equal number of micro male and micro female embossed elements, having a total tensile strength of no more than 75 grams per three inches per pound per ream basis weight, a cross direction wet tensile strength of at least 2.7 grams per three inches per pound per ream of basis weight, tensile stiffness of not more than about 1.1 grams per inch per percent strain per pound per ream basis weight, a ratio of product cross direction stretch to base sheet cross direction stretch of at least about 1.4, a GM friction deviation of no more than 0.225 and sidedness parameter less than 0.275.

2. The single-ply tissue of claim 1, wherein the tissue contains a temporary wet strength agent and a nitrogen containing softener.

3. The single-ply tissue of claim 1, wherein the tissue contains a softener which is a trivalent cationic organic nitrogen compound incorporating long fatty acid chains, a tetravalent organic nitrogen compound incorporating long fatty acid chains, an imidazoline, an amino acid salt, a linear amine amide, a tetravalent quaternary ammonium salt, a quaternary ammonium salt, an amido amine salt derived from a partially neutralized amine, or any combination thereof.

4. The single-ply tissue of claim 1, wherein the ratio of product cross direction tensile energy absorbed (grams/mm) times 1000 and cross direction tensile (grams/3 inches) is at least about 0.50.

5. The single-ply tissue of claim 1, wherein the emboss pattern used has male microelements and female microelements and wherein the largest dimension of the top of the male microelements and the bottom of the female microelements is between about 0.005 inches to about 0.070 inches.

6. The single-ply tissue of claim 5, wherein the largest dimension of the top of the male microelements and the bottom of the female microelements is between about 0.015 inches to about 0.045 inches.

7. The single-ply tissue of claim 5, wherein the largest dimension of the top of the male microelements and the bottom of the female microelements is between about 0.025 inches to about 0.035 inches.

8. The single-ply tissue of claim 1, wherein the angle of the sidewalls of the emboss microelements is between about 10 and about 30 degrees from the vertical.

9. The single-ply tissue of claim 8, wherein the angle of the sidewalls of the emboss microelements is between about 18 and about 23 degrees from the vertical.

10. The single-ply tissue of claim 1, wherein the length of the elements divided by the width of the elements is less than 3.

11. The single-ply tissue of claim 1, wherein the length of the elements divided by the width of the elements is less than 2.

12. The single-ply tissue of claim 1, wherein the length of the elements divided by the width of the elements is 1.

13. The single-ply tissue of claim 1, wherein the base of a male macroelement or the opening of a female element begins at the mid-plane of the microelements.

14. The single-ply tissue of claim 1, wherein the distance between the end of the macroelements and the start of the microelements is at least about 0.007 inches and not greater than about 1 inch.

15. The single-ply tissue of claim 1, wherein the depth or height of the microelements from the midplane is about 0.005 to about 0.045 inches.

16. The single-ply tissue of claim 15, wherein the depth or height of the microelements from the midplane is about 0.010 to about 0.035 inches.

17. The single-ply tissue of claim 15, wherein the depth or height of the microelements from the midplane is about 0.015 to about 0.020 inches.

18. The single issue of claim 1, further comprising the depth or height of the macroelements is about 0.010 to about 0.055 inches.

19. The single-ply tissue of claim 18, wherein the depth or height of the macroelements is about 0.020 to about 0.045 inches.

20. The single-ply tissue of claim 1, further comprising the depth or height of the macroelements is about 0.025 to about 0.035 inches.

21. The single-ply tissue of claim 1, wherein the sidedness parameter is in the range of about 0.180 to about 0.250.

* * * * *

UNITED STATES PATENT AND TRADEMARK OFFICE

CERTIFICATE OF CORRECTION

PATENT NO. : 6,368,454 B1
DATED : April 9, 2002
INVENTOR(S) : John H. Dwiggins et al.

It is certified that error appears in the above-identified patent and that said Letters Patent is hereby corrected as shown below:

Column 25,
Line 7, "single issue" should read -- single-ply tissue --.
Line 7, insert -- macroelements and -- after "comprising".

Column 26,
Line 4, insert -- macroelements and -- after "comprising".

Signed and Sealed this

Twenty-second Day of March, 2005

JON W. DUDAS
*Director of the United States Patent and Trademark Office*